US008091768B2

(12) United States Patent
Wisecarver et al.

(10) Patent No.: US 8,091,768 B2
(45) Date of Patent: Jan. 10, 2012

(54) BULK SHIPPING CONTAINER

(75) Inventors: Mark Anthony Wisecarver, Morristown, TN (US); William F. Moss, Canonsburg, PA (US); Martin J. Patrickus, Canonsburg, PA (US)

(73) Assignee: International Paper Company, Memphis, TN (US)

( * ) Notice: Subject to any disclaimer, the term of this patent is extended or adjusted under 35 U.S.C. 154(b) by 142 days.

(21) Appl. No.: 12/471,904

(22) Filed: May 26, 2009

(65) Prior Publication Data

US 2010/0301108 A1 Dec. 2, 2010

(51) Int. Cl.

| | |
|---|---|
| ***B65D 43/08*** | (2006.01) |
| *B65D 5/06* | (2006.01) |
| *B65D 5/56* | (2006.01) |

(52) U.S. Cl. ..... 229/109; 229/122.32; 229/122.33; 229/125.22; 229/125.26

(58) Field of Classification Search ..... 229/109, 229/122.32, 122.33, 122.34, 125.22, 125.26, 229/920, 227.3, 117.34, 117.35, 939, 117.3; 206/386, 600

See application file for complete search history.

(56) References Cited

U.S. PATENT DOCUMENTS

| | | | | | |
|---|---|---|---|---|---|
| 2,620,119 | A | * | 12/1952 | George | 229/125.26 |
| 2,794,588 | A | * | 6/1957 | George et al. | 229/125.16 |
| 2,819,009 | A | * | 1/1958 | David, Jr. | 229/125.22 |
| 2,946,494 | A | | 7/1960 | Kuss | |
| 2,962,159 | A | | 11/1960 | Sheard | |
| 2,967,655 | A | * | 1/1961 | Seger, Jr. | 229/109 |
| 3,012,660 | A | * | 12/1961 | Sheldon, Jr. | 206/525 |
| 3,433,400 | A | | 3/1969 | Hawkins | |
| 3,907,194 | A | * | 9/1975 | Davenport et al. | 229/109 |
| 3,937,392 | A | | 2/1976 | Swisher | |
| 4,013,168 | A | | 3/1977 | Bamburg et al. | |
| 4,094,455 | A | | 6/1978 | Bamburg et al. | |
| 4,208,954 | A | | 6/1980 | Chase | |
| 4,341,337 | A | | 7/1982 | Beach et al. | |
| 4,359,182 | A | | 11/1982 | Perkins | |
| 4,421,253 | A | | 12/1983 | Croley | |
| 4,516,692 | A | | 5/1985 | Croley | |
| 4,585,143 | A | | 4/1986 | Fremow et al. | |
| 4,623,075 | A | | 11/1986 | Riley | |
| 4,666,059 | A | | 5/1987 | Nordstrom | |
| 4,742,951 | A | | 5/1988 | Kelly et al. | |
| 4,771,917 | A | | 9/1988 | Heaps, Jr. et al. | |
| 4,850,506 | A | | 7/1989 | Heaps, Jr. et al. | |
| 4,890,756 | A | | 1/1990 | Waltke | |
| 4,919,306 | A | | 4/1990 | Heaps et al. | |
| 5,050,775 | A | | 9/1991 | Marquardt | |
| 5,069,359 | A | | 12/1991 | Liebel | |
| 5,348,186 | A | | 9/1994 | Baker | |
| 5,351,849 | A | | 10/1994 | Jagenburg et al. | |
| 5,474,203 | A | | 12/1995 | Baker | |

(Continued)

*Primary Examiner* — Gary Elkins
(74) *Attorney, Agent, or Firm* — Matthew M. Eslami

(57) ABSTRACT

A bulk shipping and storage container in the form of a drum is made of corrugated fiberboard and includes a bin with a sidewall, a closed bottom and an open top. The sidewall has a plurality of interconnected sidewall panels, and a rim is on an upper outer surface of the sidewall for engagement by the tines of a forklift to carry the container. The locking structure on the lid and bin enable the lid to be locked in place. The bottom of the container has adhesively attached overlapping panels that provide smooth interior and exterior surfaces. A preferred embodiment has a tray inserted in the bottom and a liner inserted in the tray and extending upwardly inside the sidewall. In another embodiment, a shock-absorbing pad is between the liner and the lid.

15 Claims, 22 Drawing Sheets

U.S. PATENT DOCUMENTS

| | | | | |
|---|---|---|---|---|
| 5,803,346 | A | 9/1998 | Baker et al. | |
| 5,941,452 | A * | 8/1999 | Williams et al. | 229/109 |
| 6,561,413 | B2 * | 5/2003 | Colby | 229/190 |
| 6,834,792 | B1 * | 12/2004 | Perkins | 229/109 |
| 7,172,108 | B2 | 2/2007 | Ingalls | |
| 7,275,679 | B2 | 10/2007 | Ingalls | |
| 8,025,206 | B2 | 9/2011 | Wisecarver et al. | |
| 8,025,208 | B2 | 9/2011 | Wisecarver et al. | |
| 2003/0160092 | A1 | 8/2003 | Philips et al. | |
| 2005/0051611 | A1 | 3/2005 | Ingalls | |
| 2006/0180643 | A1 | 8/2006 | Stephanson | |
| 2008/0023359 | A1 | 1/2008 | Churvis et al. | |

* cited by examiner

BULK SHIPPING CONTAINER

FIELD OF THE INVENTION

This invention relates to bulk shipping containers, and more particularly to a multi-sided shipping container in drum form made of corrugated fiberboard to replace the plastic, fiber or metal cylindrical shipping drums conventionally used.

BACKGROUND OF THE INVENTION

Containers of relatively large size are commonly used for the bulk transportation and storage of materials such as, e.g., solvents, lubricants, inks, dyes, abrasives, adhesives, resin, insecticides, dry chemicals, powdered detergents, grains, frozen concentrate, meat, spices, sauces, and the like. These bulk containers must be capable of withstanding the weight of the contents as well as the rough handling to which they may be subjected. Further, they should be capable of being handled with mechanized equipment, and should be capable of being stacked on top of one another.

A bulk container commonly in use comprises a cylindrical drum made of solid fiber, plastic or metal. These drums typically are provided in sizes ranging from 30 to 55 gallons size and have metal rings or bands at their top and bottom ends, with a lid or cover removably secured in place by a clamping band. The drums can be picked up and transported by mechanized equipment, including engaging the tines of a forklift under the rim provided by the band at the top of the drum. They also may be manually moved around on a supporting surface by tilting the drum and rolling the bottom edge of it along the supporting surface.

Depending upon the product stored in them, when full these cylindrical drums can weigh upwards of 500 pounds. Accordingly, manual handling of them can be difficult, especially when they are tilted and rolled along a supporting surface, since the metal band at the top does not provide much surface to grip and control the drum. Moreover, the circular configuration at the bottom end enables momentum or inertia to be built up when the drum is being rolled, making it difficult to control.

Further, due to their construction, cylindrical drums must be fully assembled and shipped to a user in their normal usable configuration. This requires substantial storage and shipping space for empty drums, adding to freight and warehousing costs. In addition, these types of drums are not easily recyclable.

Accordingly, there is a need for a bulk container that has the advantages of a cylindrical drum but that is free of the disadvantages.

SUMMARY OF THE INVENTION

The invention is a multi-sided bulk shipping container in drum form made of corrugated fiberboard and that generally looks, handles, stores, ships, and can be received like the fiber, plastic or steel cylindrical drums conventionally used. It may be moved with a hand truck, clamp truck, or forklift, and may be manually rolled on its bottom edge. It has superior stacking strength, with a top to bottom compression of 6,000 pounds, and may be stacked three high with a safety factor of 5:1. The container of the invention is easily and fully recyclable, and when empty the container of the invention may be shipped and stored in a knocked-down or flattened condition, although it can be shipped in fully assembled condition if desired. It can be provided in a variety of sizes and footprints, and preferably is designed with a footprint so that four of the containers fit side-by-side on a 40×48, 45×48 or 44×44 inch pallet. To fit on the different size pallets the footprint of the container could be selected as necessary and the height changed, for example, to accommodate a desired capacity.

Integral rim structure at the top end of the container enables the container to be picked up and carried by engaging the tines of a forklift under the rim, and the container may be manually moved by tilting and rolling it on its bottom edge. Since the container of the invention is multi-sided rather than cylindrical, the rim formed at the top has a plurality of short straight sides corresponding to the number of sides of the drum, defining a larger and more secure surface for lifting the drum by engaging the tines of a forklift under the rim than does the rim at the top of a conventional cylindrical drum. Further, this larger rim provides a larger surface for gripping and control when the container is being manually moved by tilting and rolling it on its bottom edge, and the plurality of short straight sides or surfaces provided by the multi-sided construction retards the build-up of momentum or inertia when the container is tilted and rolled on its bottom edge, thereby enhancing control over the container when it is being moved manually.

The simplest form of container according to the invention comprises a multi-sided bin or ease with a closed bottom and an open top, and a cover or lid for placement over the open top. This aspect of the invention could be used, for example, when the product placed in the container poses little risk of leakage, or when a bag is placed in the bin to contain the product, such as when the product comprises a liquid or semi-liquid material. In a preferred embodiment the bin is octagonal in shape, with eight relatively narrow straight sides, and preferably made of triplewall corrugated fiberboard. The relatively narrow side panels of the octagonal shape provide superior flexural rigidity and stacking strength, and also results in a plurality of relatively short straight surfaces in a circumferential direction of the container, facilitating manual rolling of the container on its bottom edge. An outer rim at the upper end of the bin follows the contour of the octagonal shape and thus has a plurality of straight sections presenting downwardly facing shoulders that can be securely engaged with the tines of a forklift. Moreover, since the rim extends on all eight sides of the container it is easily accessed for all fork truck approaches to the container. The bottom of the bin is constructed so that it is strong and leak-resistant and preferably so that it provides a flat smooth surface on both the interior and exterior of the bin. Means on the bin and lid form locking structure that may be interlocked for locking the lid to the bin if desired.

In a further preferred embodiment, a tray is placed in the bottom of the bin and an open-ended liner is seated in the tray and extends the full height of the bin. This form of the invention provides a leak-proof container without using a bag, but a bag may be used if desired. The cover, liner and tray may be of single wall construction or other suitable construction as desired or necessary.

In an alternate preferred embodiment the liner terminates short of the upper end of the bin and a shock-absorbing and force distributing pad is placed in the bin between the lid and the top end of the liner. The pad strengthens and reinforces the upper end of the container against opening in the event the container is tipped over onto its side and preferably is of triplewall construction.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAIL DESCRIPTION OF THE INVENTION

Figure 1:
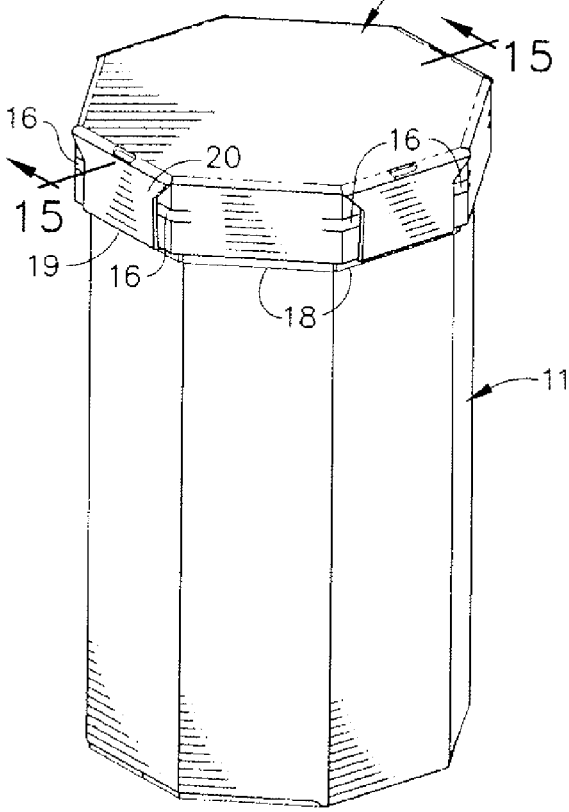
FIG. 1 is a top perspective view of a container according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
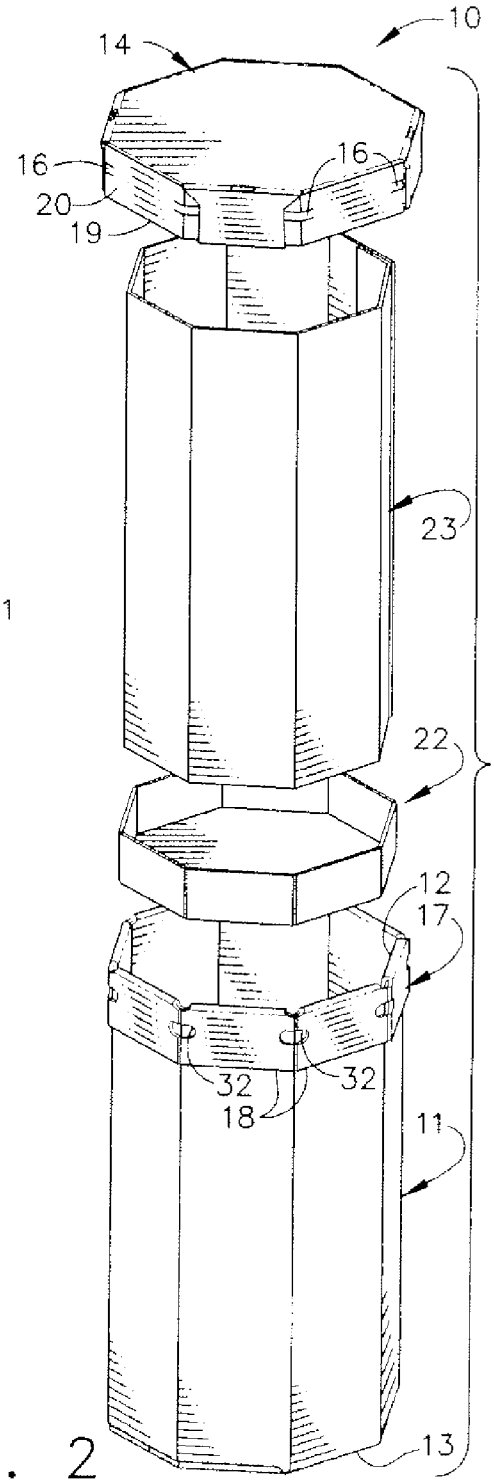
FIG. 2 is an exploded perspective view of the bin, tray, liner and lid according to a preferred form of the invention.
Figure 3:
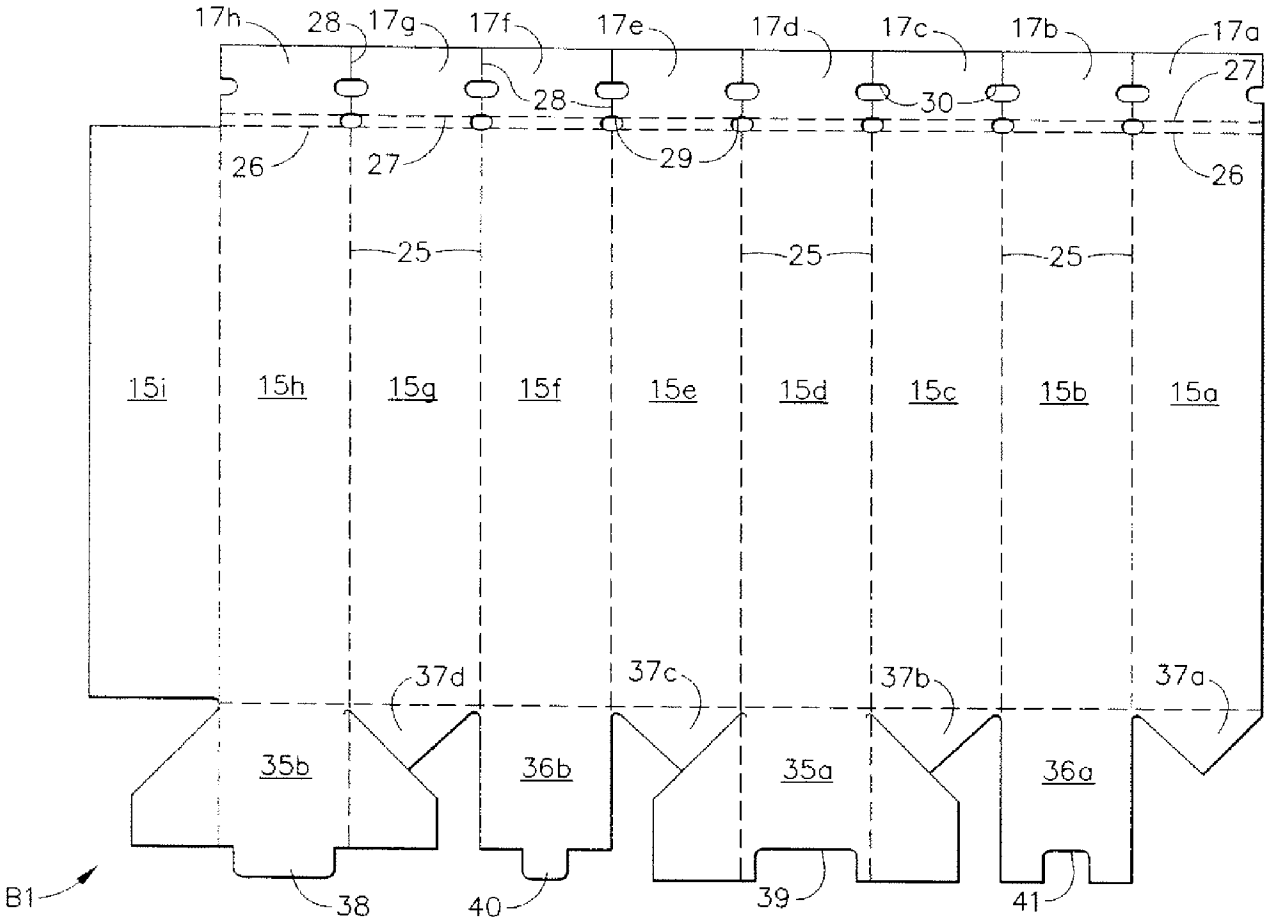
FIG. 3 is a plan view of a blank for making the bin according to a preferred embodiment of the invention.
Figure 28:
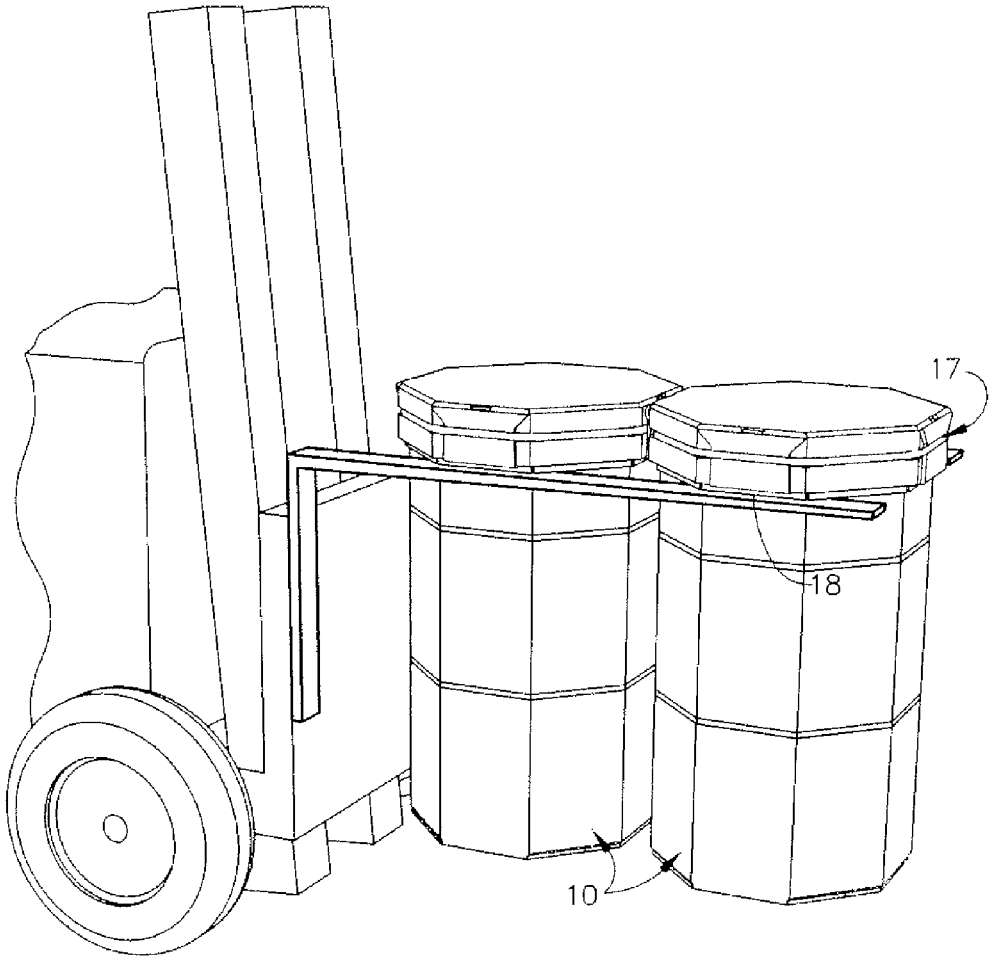
FIG. 28 depicts containers according to the invention being lifted to an elevated position by a forklift.

A container 10 according to the invention is indicated generally in FIGS. 1 and 2. The container 10 comprises a bin or case 11 with an open top 12, a closed bottom 13, and a cover or lid 14 closing the open top. In a preferred embodiment, the bin 11 is octagonal and has eight sidewall panels **15*a*-15*h*. As described in more detail hereinafter, a locking feature 16 is provided on the lid and the bin 11 to lock the lid 14 to the bin if desired. As seen best in FIG. 2, a rim 17 extends around the upper end of the bin 11 and presents a downwardly facing shoulder 18. The rim 17 comprises a series of short straight sections 17*a*-17*h* each having a length substantially the same as the width of the associated sidewall panel, and as seen in FIG. 1, the width of the rim 17 is such that the shoulder 18 is spaced slightly below the bottom edge 19 of the cover sidewall 20. This enables the tines of a forklift to engage the rim 17 to lift and carry the container 10, as depicted in FIG. 28**.

With reference to FIG. 2, which shows a preferred embodiment, a tray insert 22 is placed in the bottom of the bin 11, and an open-ended sleeve or liner insert 23 is seated in the tray and extends substantially the full height of the bin 11. The tray fits snugly in the sidewall of the bin, and the bottom end of the liner fits snugly in the tray 22. The container may be used without the tray insert 22 and liner insert 23, but their use ensures a leak-proof container, especially when liquids or semi-liquids are placed in it.

Figure 4:
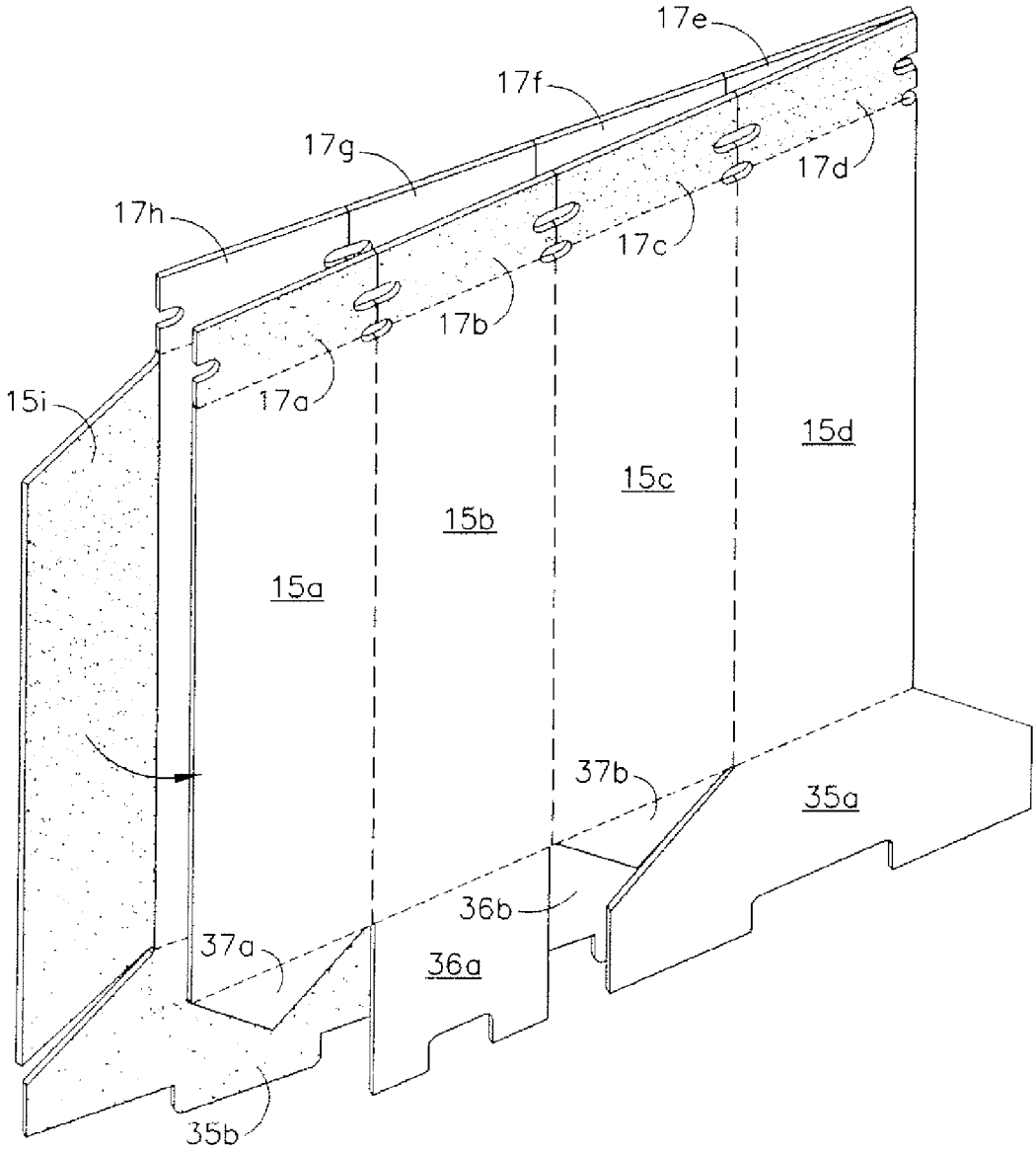
FIG. 4 is a perspective view showing the blank of FIG. 3 folded upon itself and depicting the glue panel in partially folded position.
Figure 9:
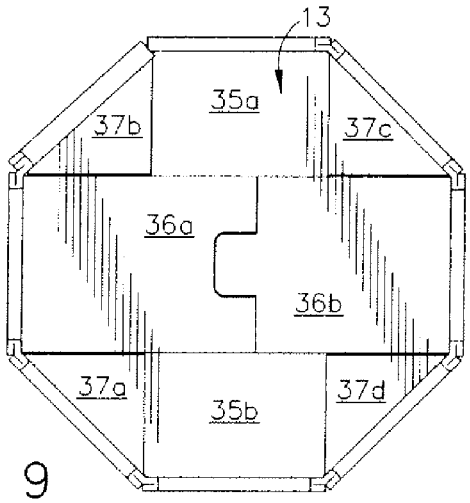
FIG. 9 is a plan view of the interior of the bottom of the bin, showing the relationship of the bottom flaps after they have been folded and secured to one another.
Figure 10:
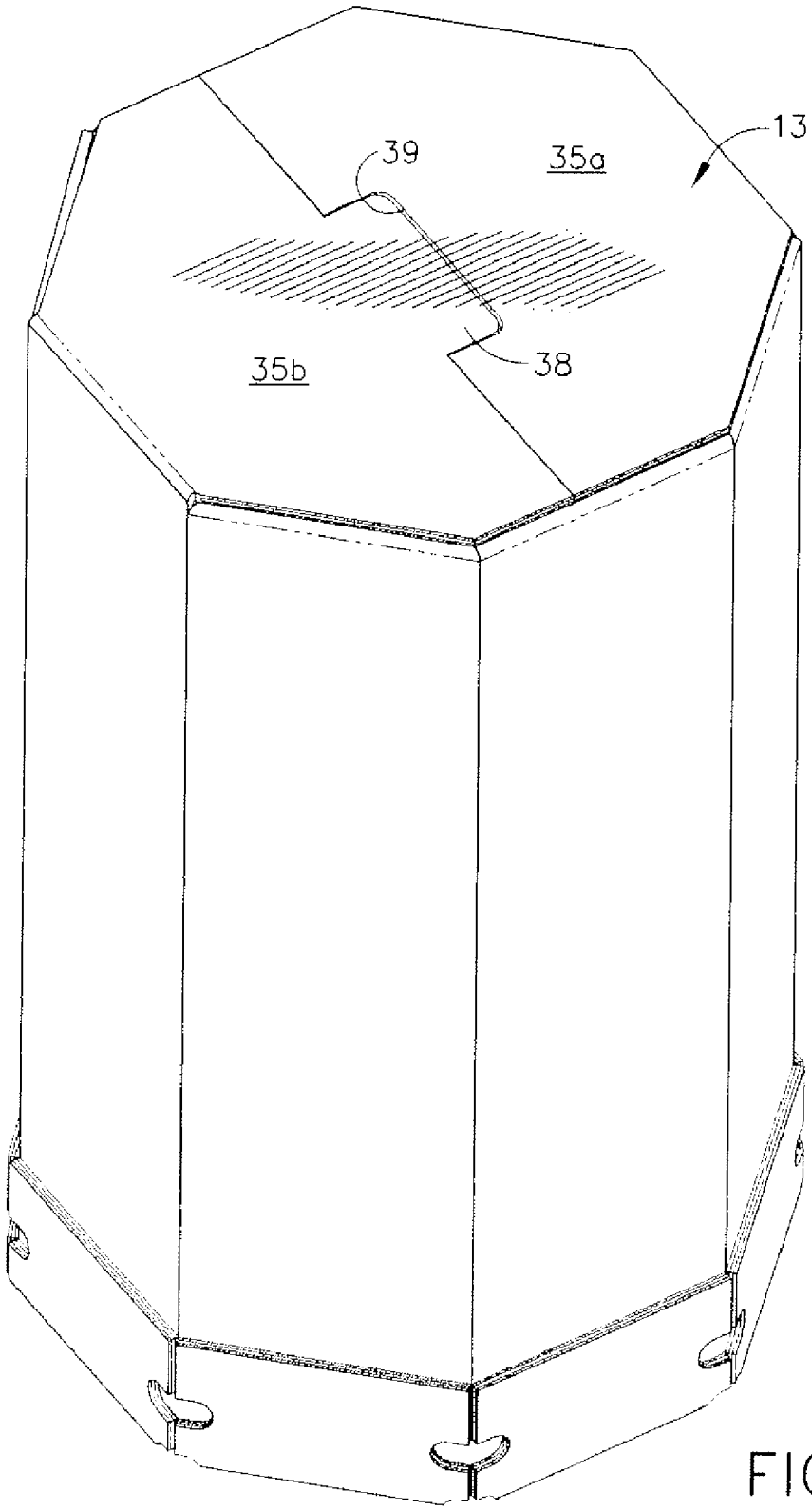
FIG. 10 is a fragmentary perspective view showing the flat smooth outer bottom of the bin when the bottom flaps are fully folded and secured together.
Figure 11:
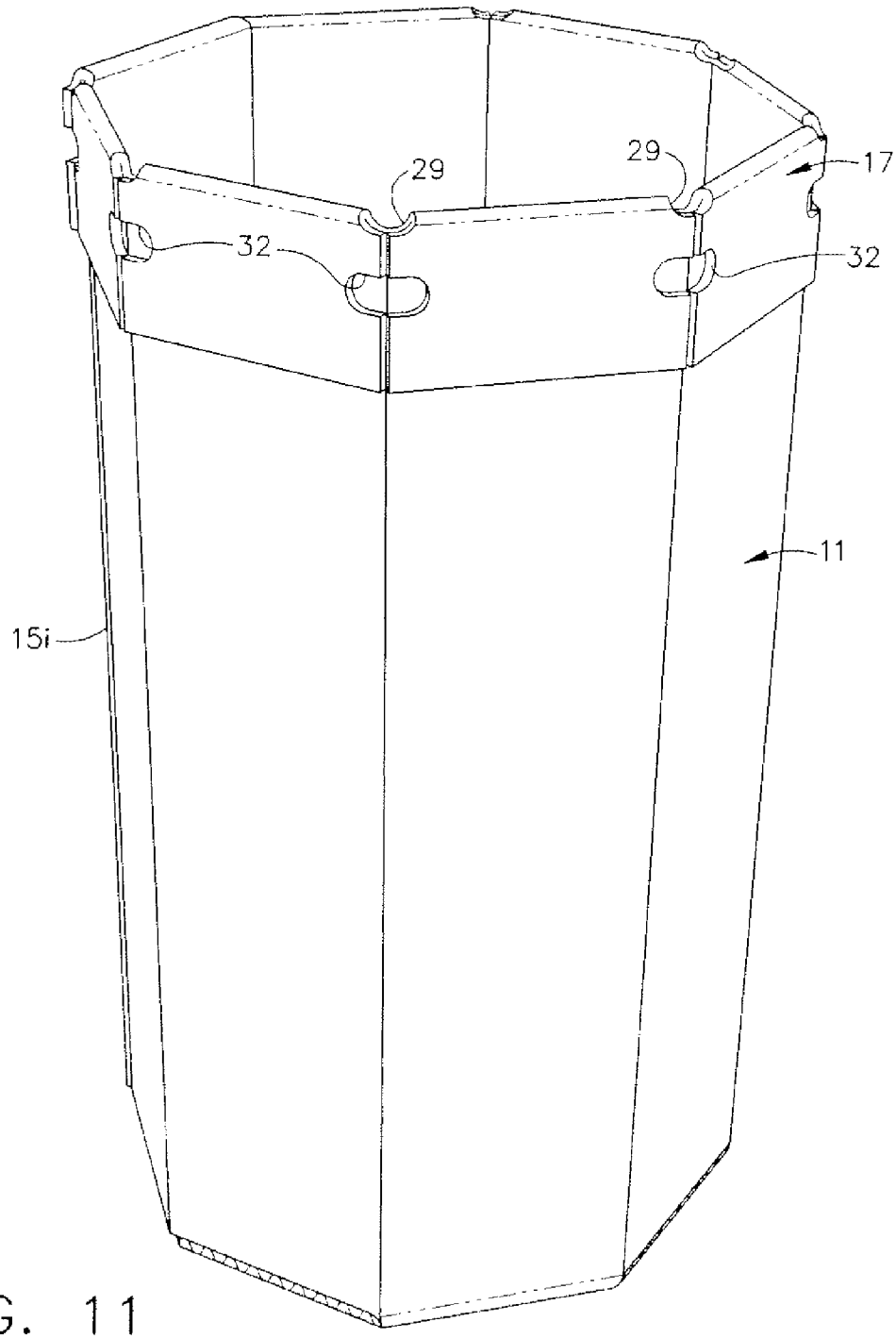
FIG. 11 is a top perspective view of a bin according to the preferred embodiment.

A blank B1 for making a preferred embodiment of the bin of the invention is illustrated in FIGS. 3-10. The blank B1 has eight substantially identical elongate rectangular sidewall-forming panels **15*a*-15*h* joined together along spaced parallel fold scores 25, and a substantially identical panel 15*i* at one end of the blank forming a glue panel. When the blank B1 is folded onto itself to form the bin, as shown in FIG. 4, the glue panel 15***i* overlaps and is glued to wall-forming panel 15*a*. Rim-forming flaps 17*a*-17*h* are foldably joined to one end of the respective panels 15*a*-15*h* along a double fold score 26, 27, and are separated from one another by cuts 28. The area between the scores 26, 27 is crushed and a series of small stress relieving cutouts 29 are made at the base of the cuts 28 and between the scores 26, 27, extending slightly into the ends of scores 25 to prevent tearing of the material when the flaps are folded 180 degrees to lie against the outer surface of the side panels as seen in FIGS. 2 and 5-7. A series of second cutouts 30 are made in the flaps 17*a*-17*h*, extending across approximately the midpoint of the cuts 28, defining recessed areas or notches 32 extending across each corner of the rim 17 in a container erected from the blanks as seen in FIGS. 2 and 11. These notches define part of the lid locking structure mentioned previously.

Figure 8:
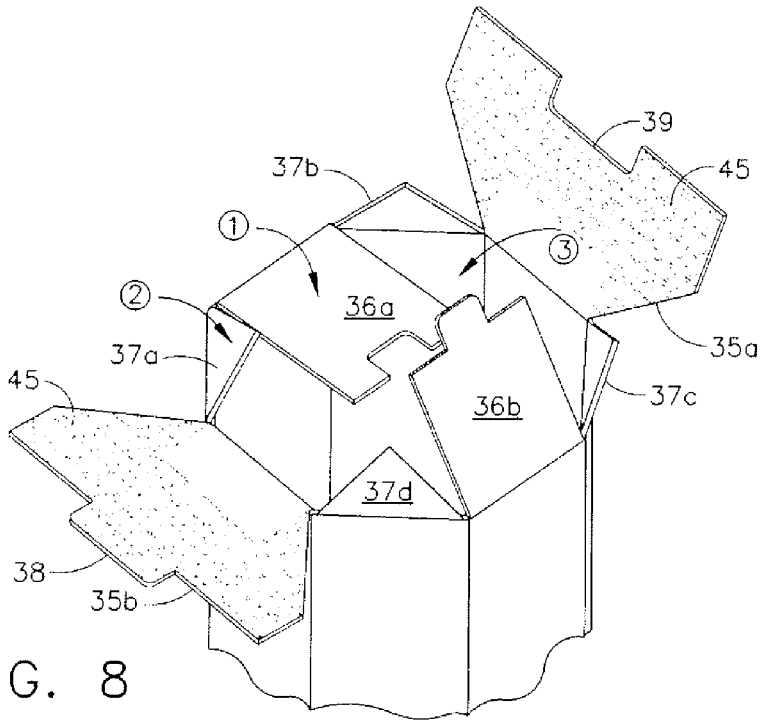
FIG. 8 is a fragmentary perspective view of the bottom end of the bin, showing the bottom flaps being folded into operative position.

Bottom-forming flaps are foldably joined along the edge of the blank B1 opposite the rim-forming flaps 17*a*-17*h*, and include a pair of generally hexagonally shaped major bottom flaps 35*a* and 35*b* that are disposed in opposed relationship to one another when the bin 11 is erected from the blank, a pair of U-shaped rectangular shaped minor bottom flaps 36*a* and 36*b* that are in opposed relationship to one another and disposed orthogonally to the flaps 35*a* and 35*b* when the bin 11 is erected, and intermediate triangularly shaped flaps 37*a*-37*d* attached to the side panels located between the side panels carrying the major and minor flaps. The outer end edge of one of the major bottom flaps 35*a* and 35*b* has an outwardly projecting tab 38 and the outer end edge of the opposite major bottom flap has a complemental notch 39. Similarly, the outer end edge of one of the minor bottom flaps has an outwardly projecting tab 40 and the outer end edge of the opposite minor bottom flap has a complemental notch 41. These tabs 38, 40 and notches 39, 41 serve as an aligning feature when the bin 11 is being set up from its knocked-down of folded flat condition, as depicted in FIGS. 8-10.

Figure 5:
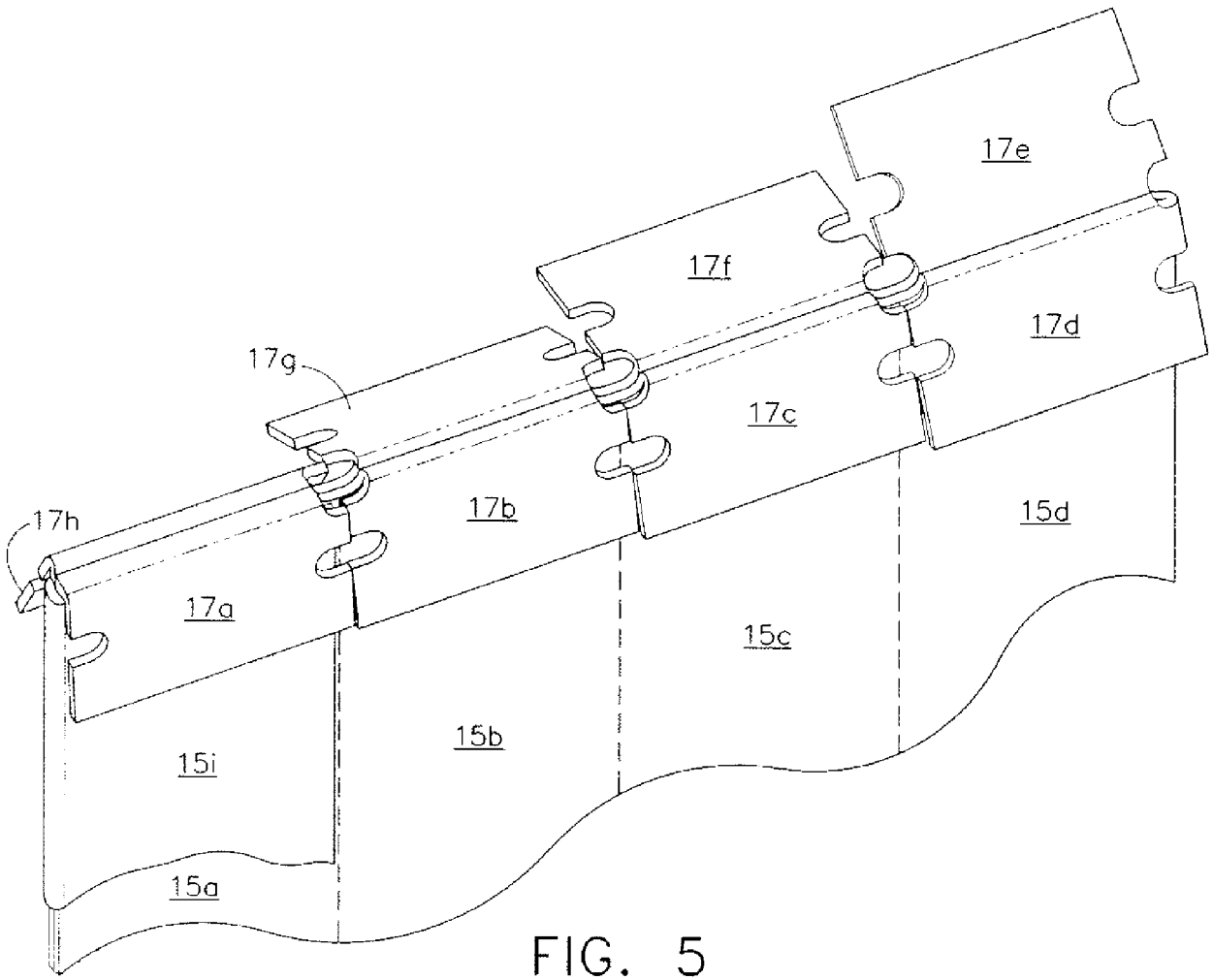
FIG. 5 is a fragmentary perspective view of the blank of FIG. 3 showing the glue panel in glued position and depicting the top flanges being folded and secured to the sidewall to form the rim at the top of the container.
Figure 6:
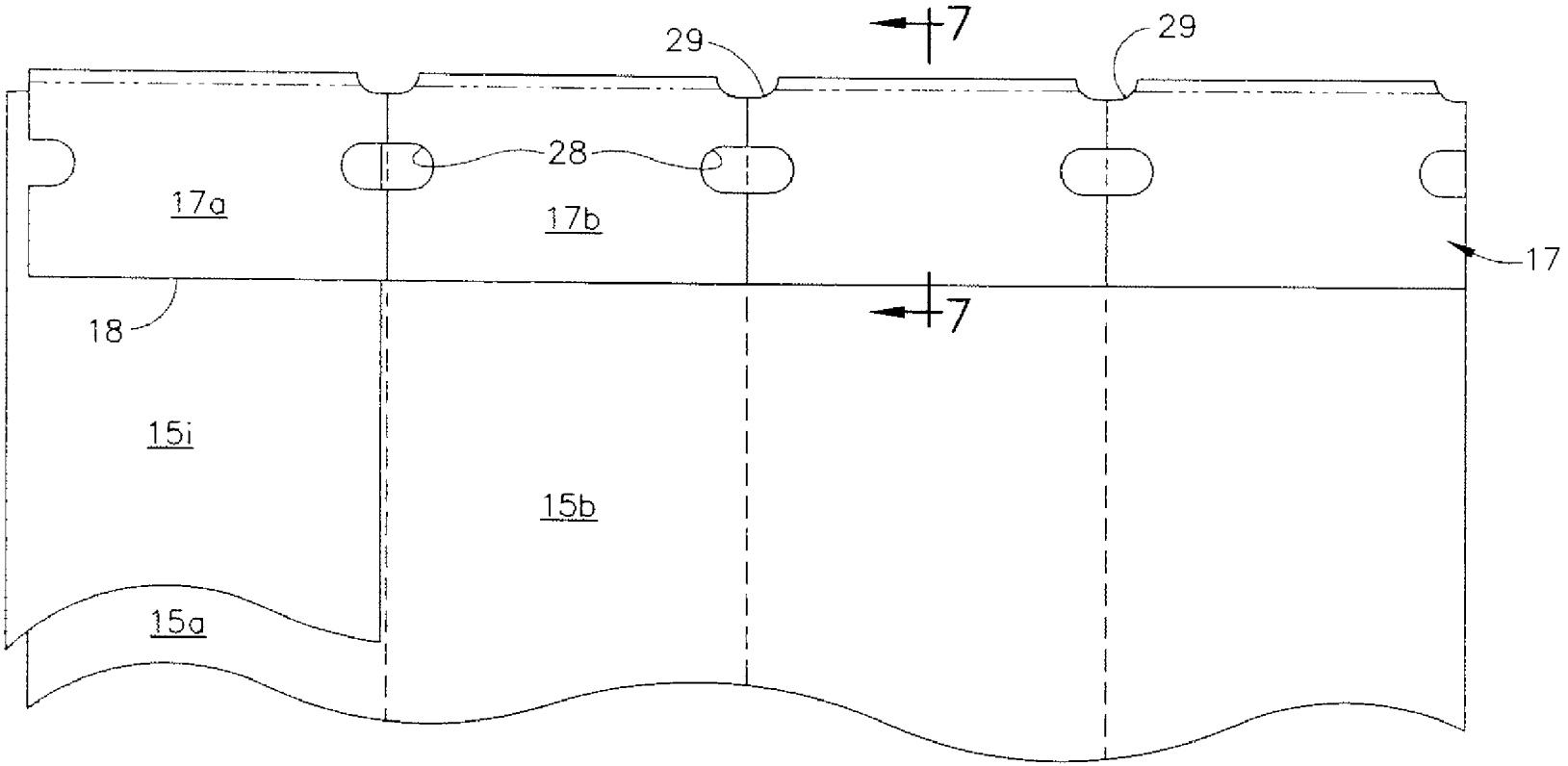
FIG. 6 is a fragmentary side view in elevation of the blank of FIG. 4, with the top flaps folded against and secured to the sidewall.
Figure 7:
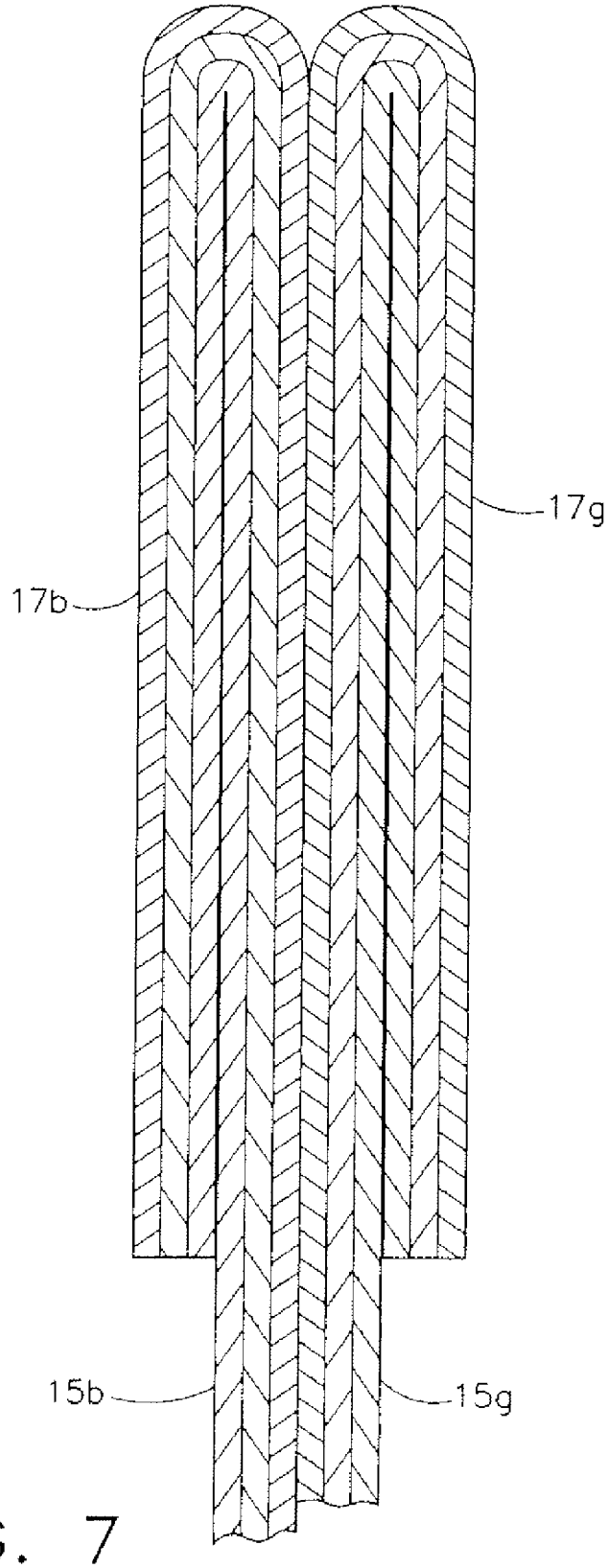
FIG. 7 is a fragmentary sectional view taken along line 7-7 in FIG. 6.

To erect the bin from the blank B1, the blank is folded in half and the glue panel 15*i* is adhesively attached in overlapping relationship to sidewall panel 15*a* as depicted in FIG. 4. The rim-forming flaps 17*a*-17*h* are then folded through 180° and secured to the upper outer surface of the respective sidewall panels 15*a*-15*b* as depicted in FIGS. 5-7. The flaps 17*a*-17*h* preferably are secured to the sidewall panels with an adhesive, but other means of attaching the flaps to the sidewalls may be used if desired and/or appropriate. The bin 11 is then opened up into a tubular configuration as shown in FIG. 8, and the minor bottom flaps 36*a* and 36*b* are folded inwardly, followed by inward folding of the intermediate flaps 37*a*-37*d*, and then followed by inward folding of the major bottom flaps 35*a* and 35*b*. When the flaps are all folded inwardly over the bottom of the bin 11, the major bottom flaps 35*a* and 35*b* completely overlap both the minor bottom flaps and the intermediate bottom flaps, and as indicated by the shaded areas in FIG. 8, adhesive 45 is applied to the major bottom flaps over the entire area where they overlap the other bottom flaps. The tabs 38, 40 and notches 39, 41 on the ends of the major and minor bottom flaps serve to align the flaps into proper relationship with one another and to square up the bin 11. Further, the size and shape of the bottom-forming flaps produces a flat smooth surface on both the interior and exterior of the bin, as depicted in FIGS. 9 and 10, wherein FIG. 9 is a plan view of the interior surface of the bottom and FIG. 10 is a perspective view of the outer surface. FIG. 11 is a top perspective view of a fully erected bin 11 in accordance with the invention.

Figure 12:
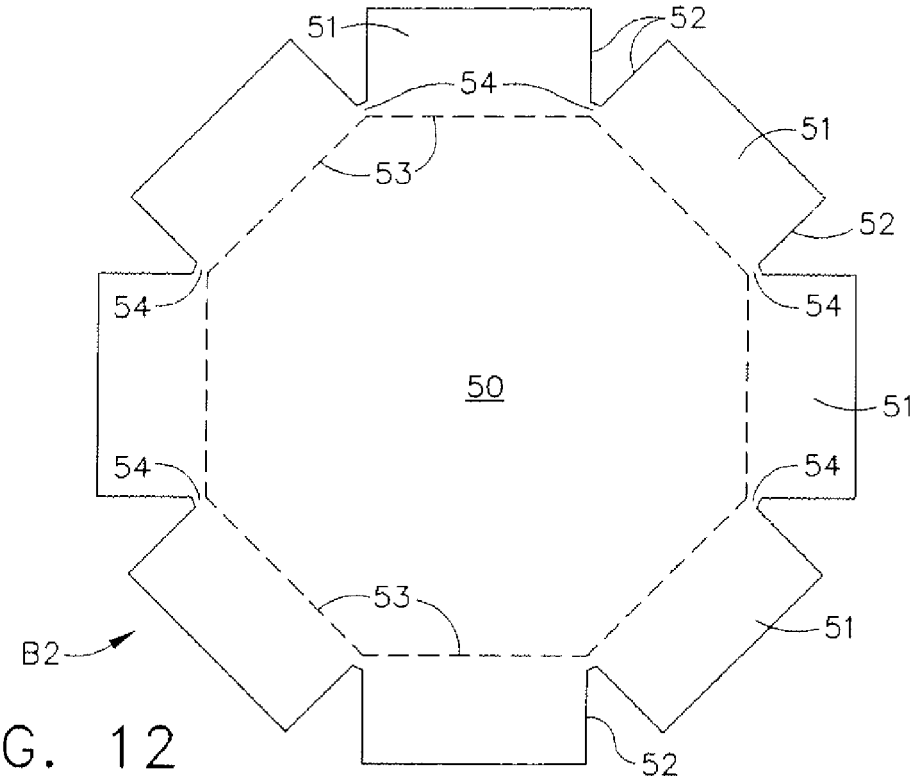
FIG. 12 is a plan view of a blank for making a tray insert for a preferred embodiment of the invention.

A blank B2 for making the optional but preferred tray insert 22 is shown in FIG. 12. The blank B2 comprises a central panel 50 shaped corresponding to the shape of the bin 11—octagonal in the example shown—and flaps 51 extending from each straight edge of the central panel 50. The flaps 51 are separated from one another by cutouts 52 that terminate a short distance from the fold 53 joining the respective flaps to the central panel, leaving a small gusset 54 at the base of the cutout 52 on each side of the flaps. To erect the tray insert 22, the flaps 51 are simply folded upwardly as shown in FIG. 2.

Figure 13:
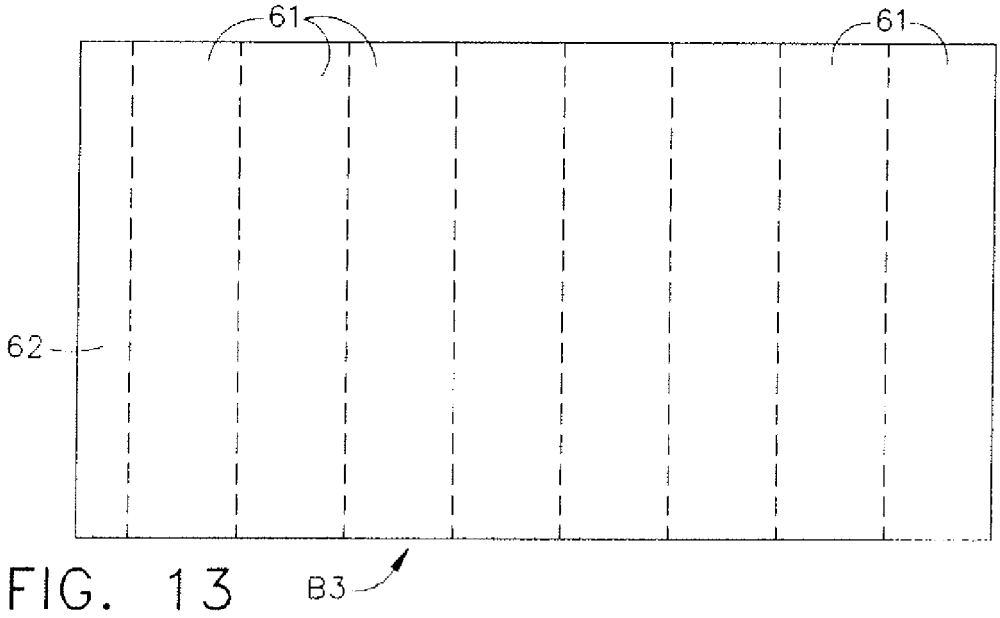
FIG. 13 is a plan view of a blank for making an open-ended liner insert for a preferred embodiment of the invention.
Figure 14:
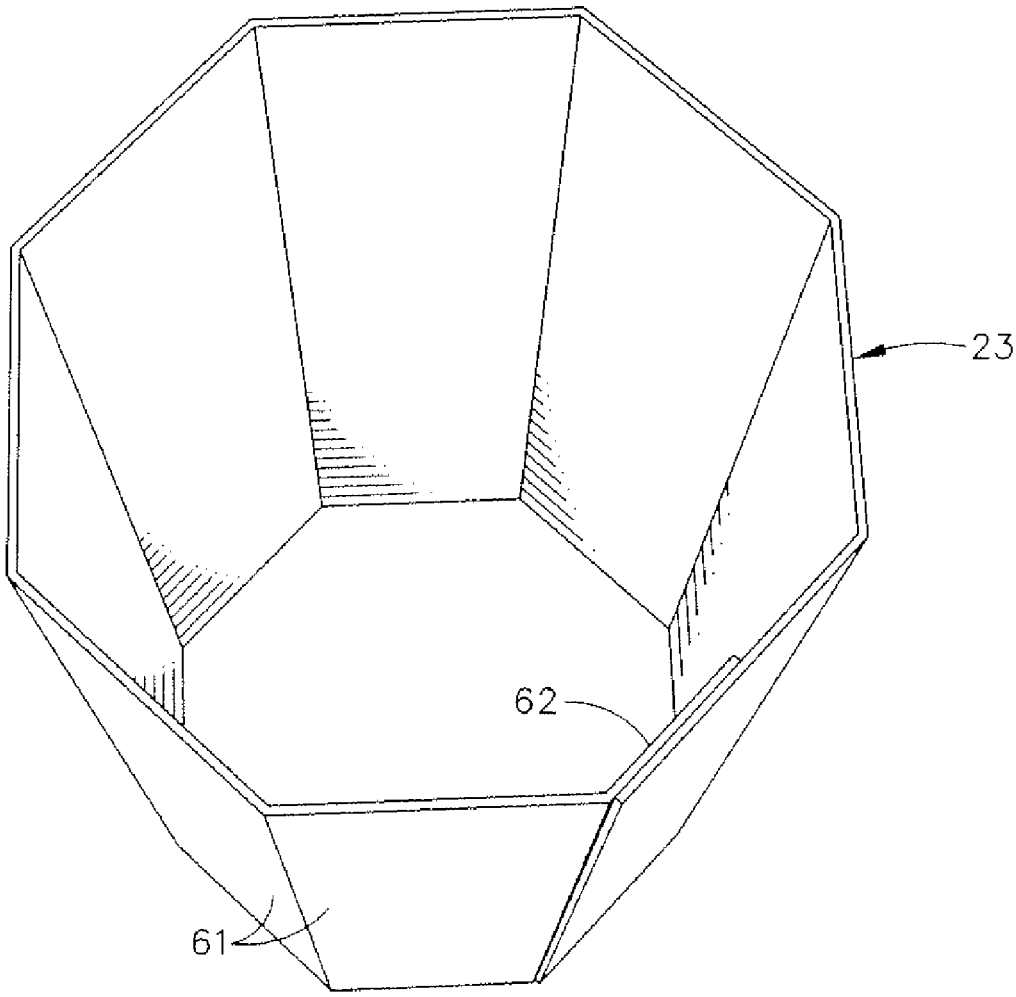
FIG. 14 is a perspective view showing a liner insert ready to be positioned in the bin.

A blank B3 for making the liner insert 23 is shown in FIG. 13. The liner insert has a plurality of side panels 61 corresponding in number to the side panels of the bin 11, and a glue panel 62 at one end of the blank. In that form of the invention shown in FIGS. 2 and 18 the liner insert has a height the same as the height of the bin 11. However, one of ordinary skilled in art will appreciate that that the height of the liner insert may be different from the height of the bin 11. A liner insert 23 erected from the blank B3 is shown in FIG. 14. In use, the tray insert 22 is placed in the open upper end of the bin 11 and the liner insert 23 positioned in the tray and pushed down into the bin as shown in exploded view in FIG. 2.

Figure 16:
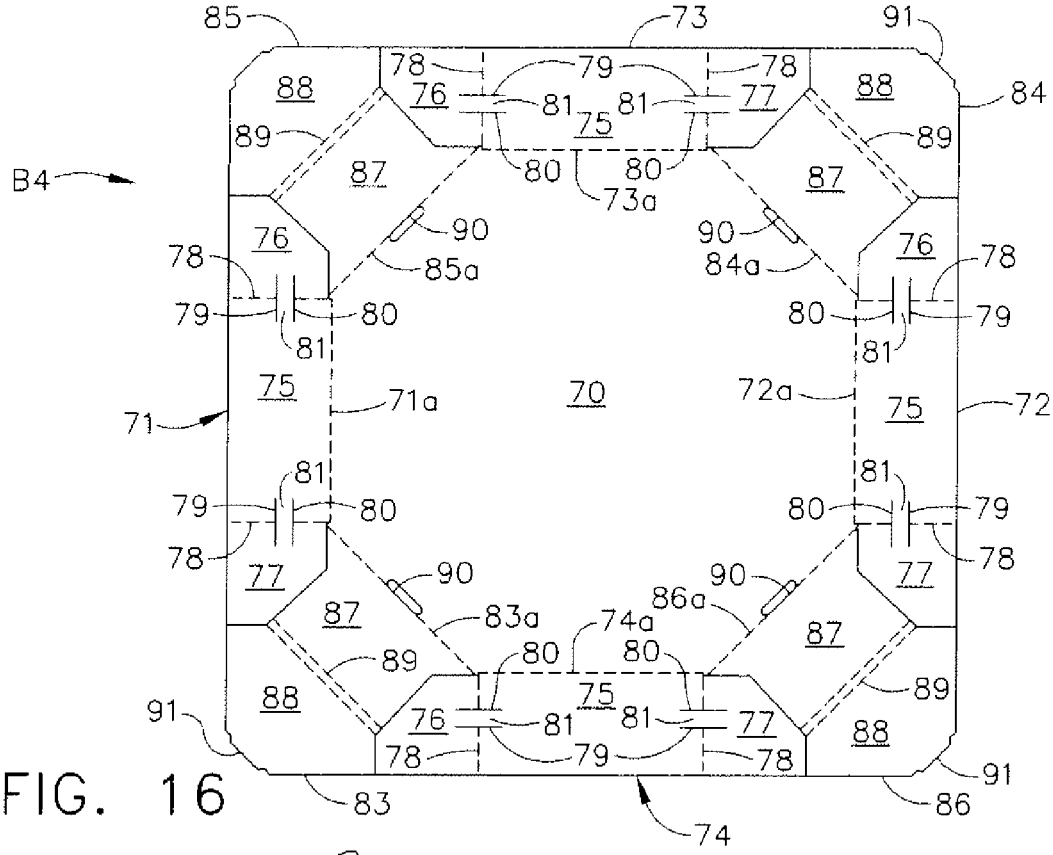
FIG. 16 a plan view of a blank for making a cover or lid according to a preferred embodiment of the drum of the invention.

A blank B4 for making the lid 14 is shown in FIG. 16. For the preferred octagonal shape of the container of the invention the blank B4 has an octagonal center panel 70 with a first pair of opposed side flaps 71, 72 foldably joined to respective opposite edges of the center panel along opposed parallel fold scores 71*a*, 72*a*. A second pair of opposed side flaps 73, 74 is foldably joined to respective opposite edges of the center panel along fold scores 73*a*, 74*a* disposed orthogonally to the fold scores 71*a*, 72*a*. The side flaps 71, 72 and 73, 74 are identical to one another and each comprises a rectangular panel 75 equal in width to the adjacent edge of the center panel 70, with assembly flaps 76, 77 foldably joined to opposite ends thereof along fold scores 78. A pair of spaced parallel cuts 79 and 80 extend across each fold score 78 to define a bendable strip 81 between the cuts. A third pair of opposed side flaps 83, 84 is foldably joined to respective opposite edges of the center panel along fold scores 83*a*, 84*a* extending angularly between respective adjacent ends of the fold scores 71*a*, 74*a* and 72*a*, 73*a*. A fourth pair of opposed side flaps 85, 86 is foldably joined to respective opposite edges of the center panel along fold scores 85*a*, 86*a* extending angularly between respective adjacent ends of the fold scores 71*a*, 73*a* and 72*a*, 74*a*. The side flaps 83, 84 and 85, 86 are identical to one another and each comprises a first irregularly shaped panel 87 with inset side edges, and a second irregularly shaped panel 88 joined to the first panel along a double fold score 89. The first panel 87 forms an outer side panel and the second panel 88 forms an inner side panel in a lid erected from the blank. A slot 90 is formed in the center panel 70 adjacent the midpoint of each of the fold scores 83*a*, 84*a*, 85*a* and 86*a*, and a tab 91 projects from the center of the outer end edge of each of the panels 88.

Figure 17:
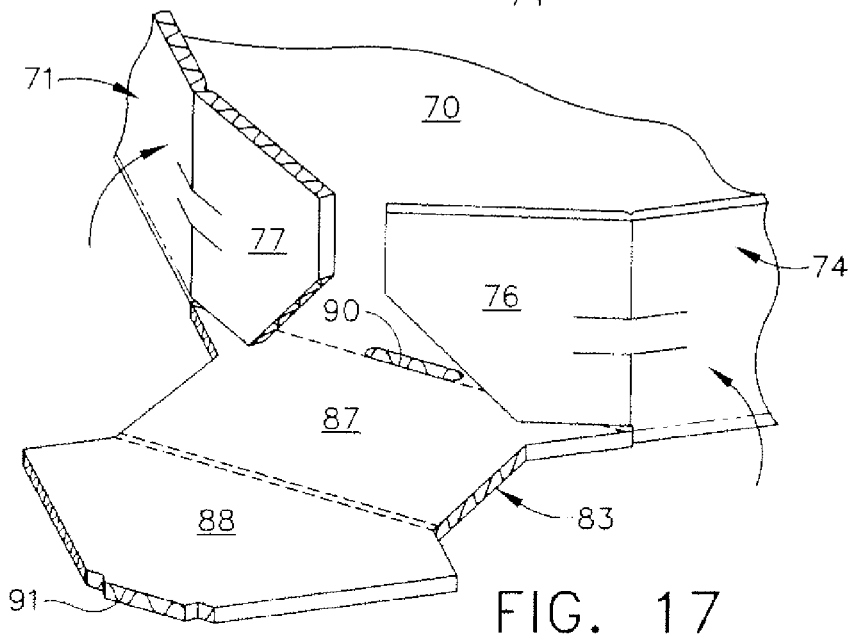
FIG. 17 is an enlarged fragmentary perspective view of a portion of the lid of FIG. 19, showing a first step in the sequence of folding the panels to make the lid.
Figure 18:
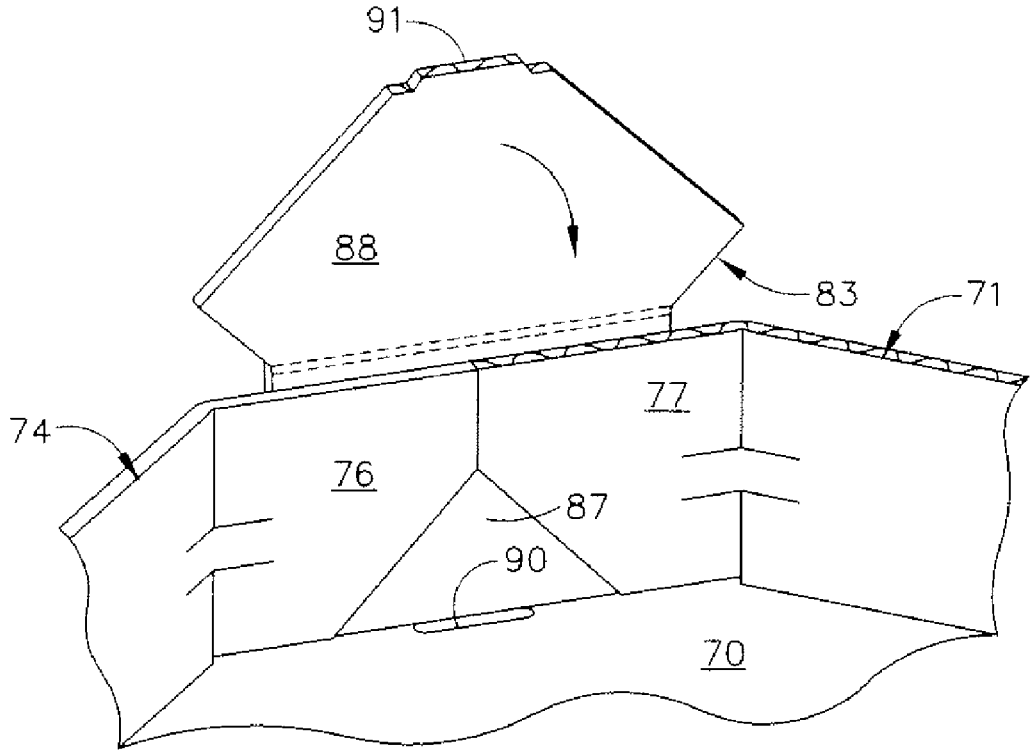
FIG. 18 is an enlarged fragmentary perspective view showing another step in folding the lid into operative condition.
Figure 19:
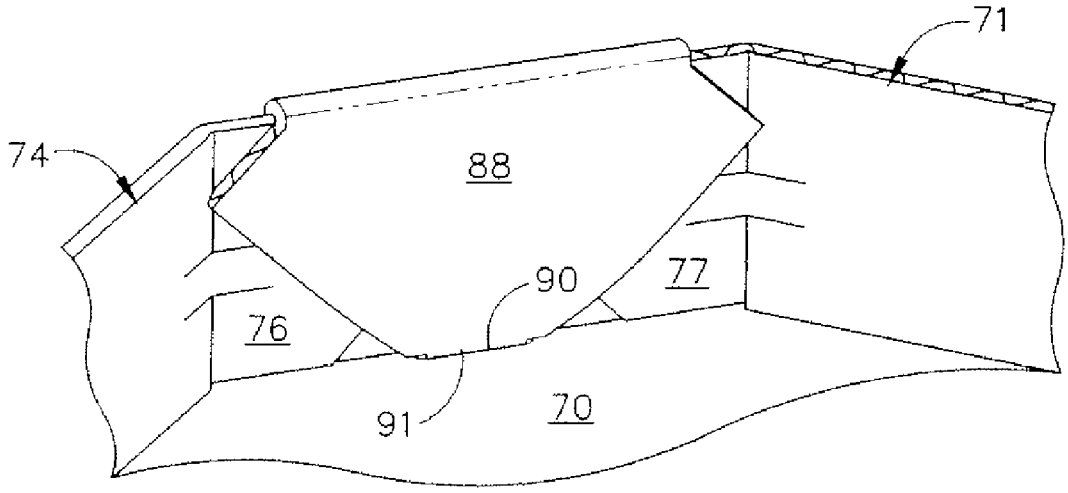
FIG. 19 is an enlarged fragmentary perspective view showing a portion of the lid in fully folded interlocked condition.
Figure 20:
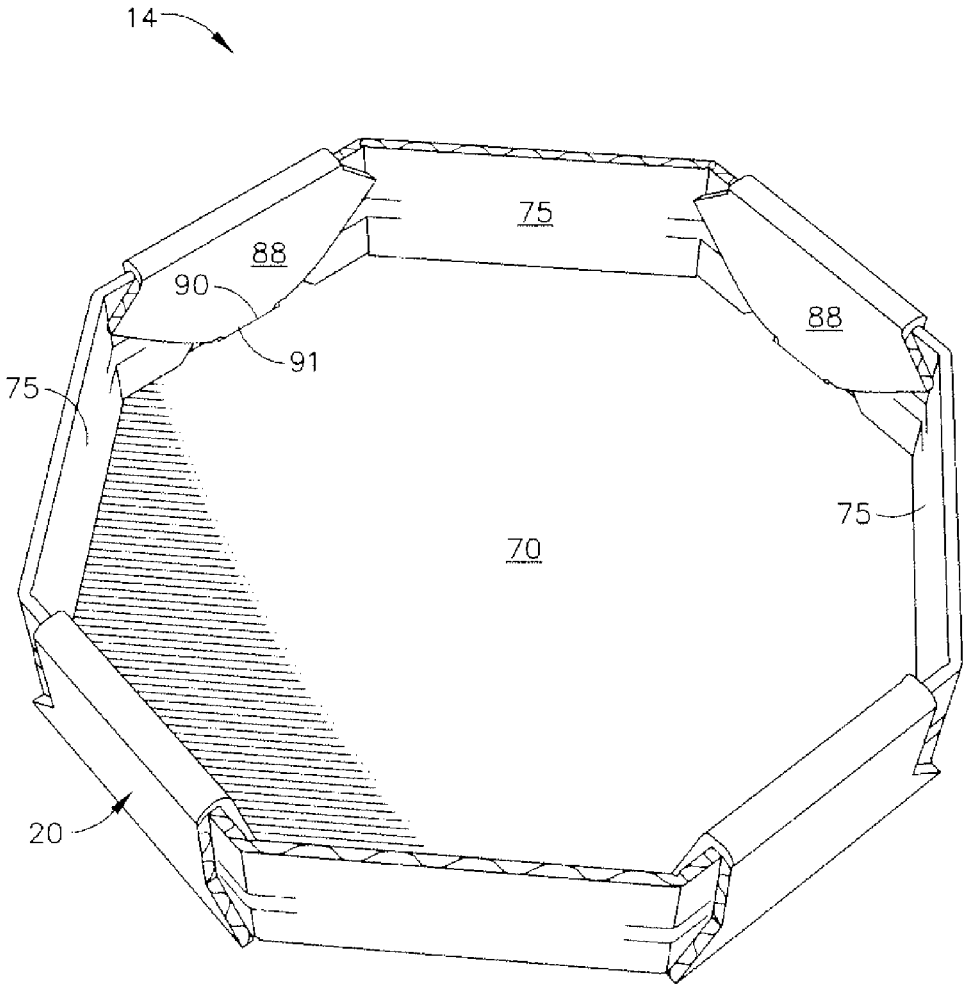
FIG. 20 is a perspective view looking at the underside of the lid in its fully folded erected condition.

The blank B4 is folded according to the sequence depicted in FIGS. 16-19 to form the lid 14, shown inverted in FIG. 20. The side flaps 71, 72, 73 and 74 are first folded upwardly, and the assembly flaps 76, 77 are folded inwardly, as depicted in FIG. 17. The side flaps 83, 84, 85 and 86 are then folded upwardly as shown in FIG. 18, and the panels 88 are folded inwardly and downwardly over the assembly flaps 76, 77 to engage the tabs 91 in slots 90 as shown in FIG. 19, holding the lid in erected condition as shown in FIG. 20. When the lid is placed on the container 10 as shown in FIGS. 1 and 18-20 the bendable strips 81 may be pushed inwardly to extend into the recessed areas or notches 32 on the corners of the bin to lock the lid 14 to the bin 11.

Figure 15:
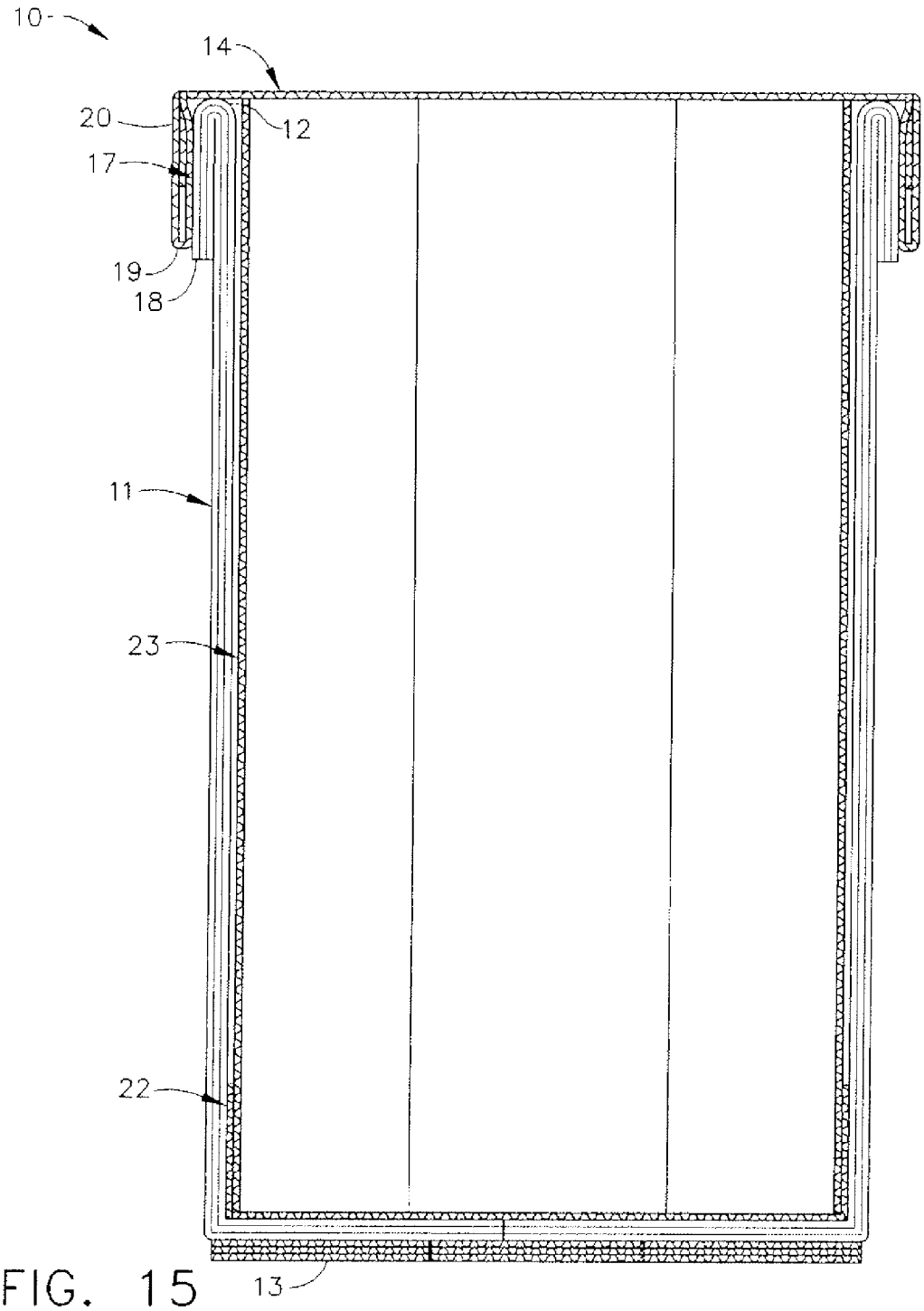
FIG. 15 is a longitudinal cross-sectional view of the container taken along line 15-15 in FIG. 1.
Figure 31:
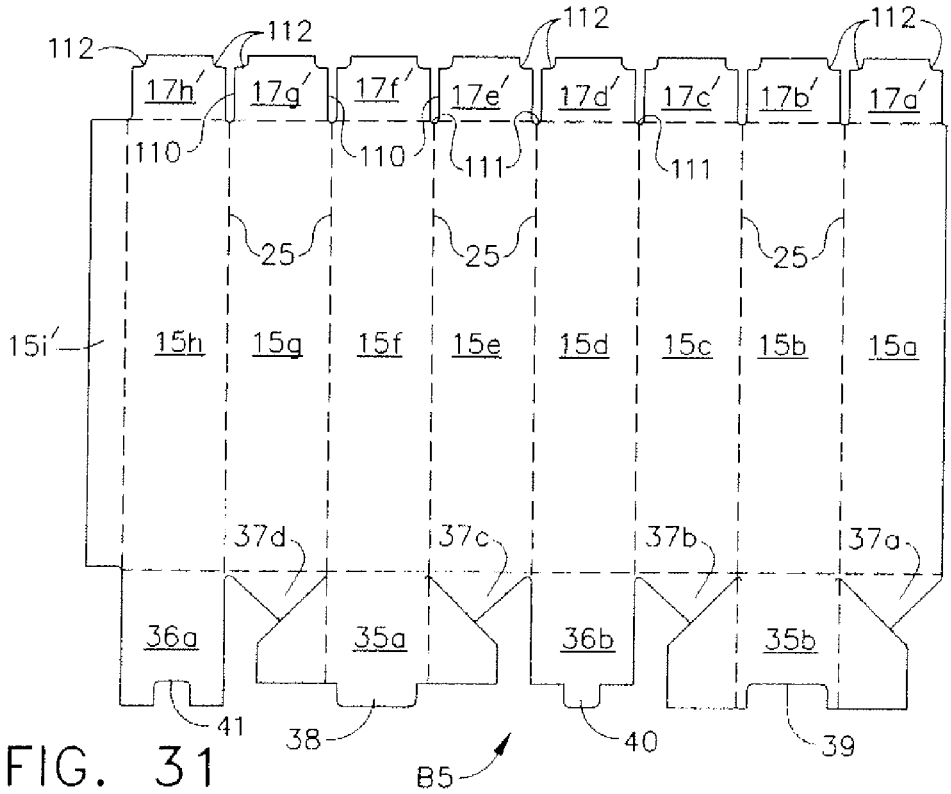
FIG. 31 is a plan view of a blank for making an alternate embodiment of bin according to the invention.

FIG. 15 depicts a longitudinal cross sectional view of the container 10 taken along line 15-15 in FIG. 1. It can be seen that the tray 22 is positioned in the bottom of the bin 11 and one end of the open-ended sleeve or liner insert 23 is seated in the tray 22. Moreover, the upper end of the liner insert 23 is aligned with the top edge of the bin 11. Although the height of the liner insert 23 and the height of the bin 11 are shown substantially the same, but depending on the configuration, the height of the liner insert 23 can be shorter than the height of the bin 11. It should also be noted that the height of lid 14 is slightly shorter than the height of downwardly facing shoulder 18 of the rim 17 so that the tines of a forklift machine engages the rim 17 to lift and carry the container, as depicted in FIG. 31. In FIG. 15, the lid 14 is illustrated as single wall, but the lid can be double or triple wall, if desired. Likewise, the liner insert 23 is depicted as single wall, but the liner insert can be double or triple wall, if desired.

Figure 21:
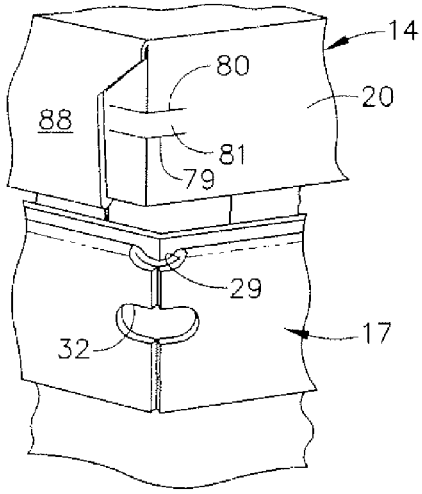
FIG. 21 is an enlarged fragmentary view in side elevation, showing a top portion of the drum and associated part of the lid with the structure that forms the interlock for locking the lid to the drum.
Figure 23:
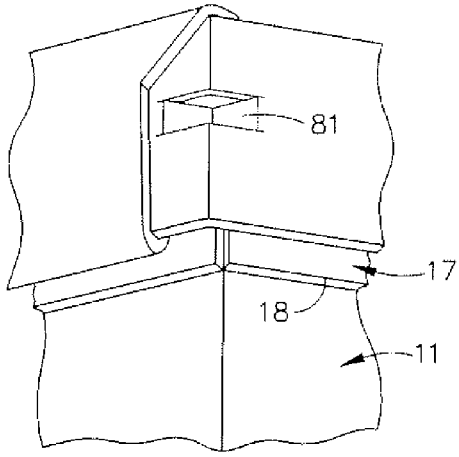
FIG. 23 shows the lid placed on the bin and the interlock structure engaged.
Figure 22:
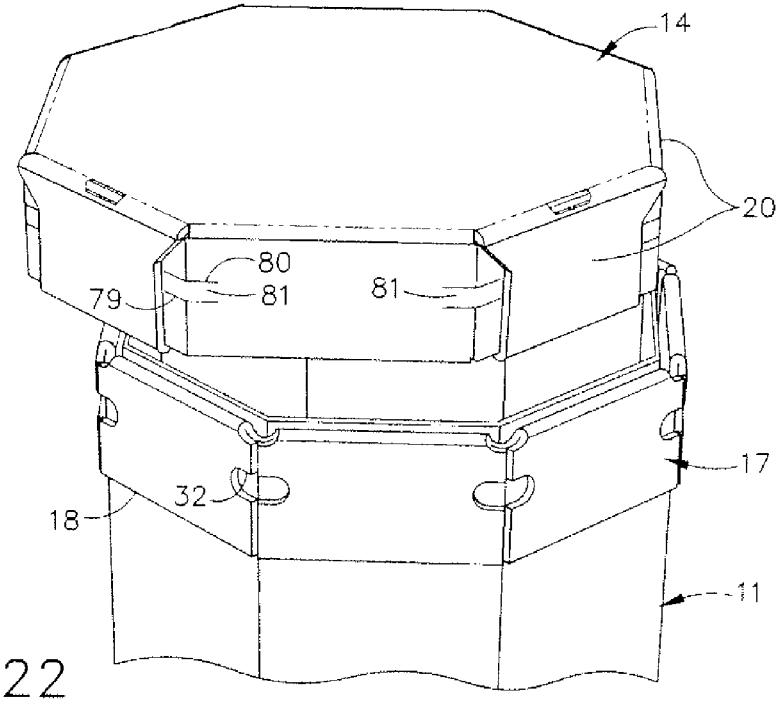
FIG. 22 shows the lid being positioned on the bin.
Figure 24:
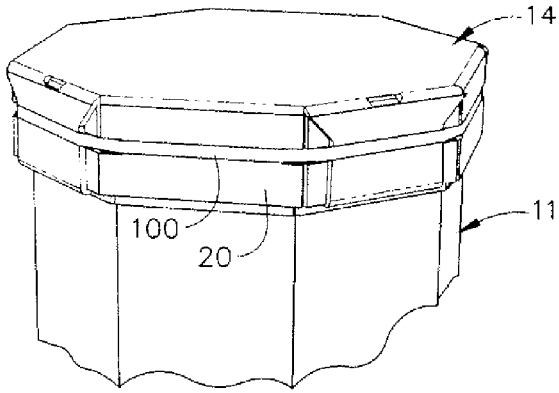
FIG. 24 is a fragmentary top perspective view of a container according to the invention, with a strap around the lid, reinforcing and securing it to the bin.

If desired a strap or band 100 may be placed around the skirt of the lid 14, as is illustrated in FIG. 24, in the depressions left by pushing the strips 81 inwardly, as shown in FIG. 21. The strap presses the strips into the notches 32 in the corners of the bin 11 and firmly anchors the lid 14 to the bin. In addition to securing the lid 14 on the bin 11, the depressions serve as a guide for positioning the strap 100 and retaining it in position.

Figure 25:
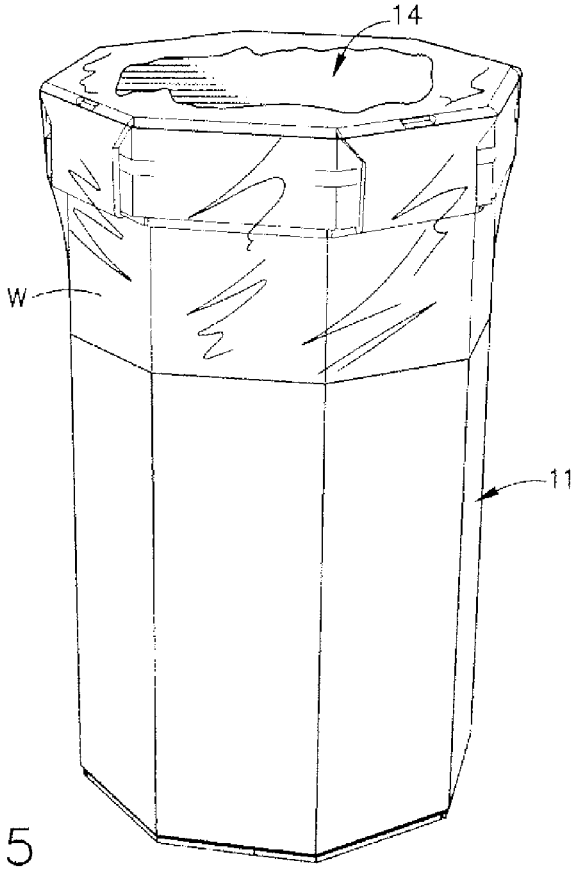
FIG. 25 is a top perspective view of a container according to the invention, with stretch film applied to the top of the container as an alternate means of securing the lid in position on the bin.

Alternatively, or in addition to the strap 100, stretch wrap or shrink wrap or the like W may be applied around the upper end of the container to help hold the lid 14 in place, as shown in FIG. 25.

Figure 26:
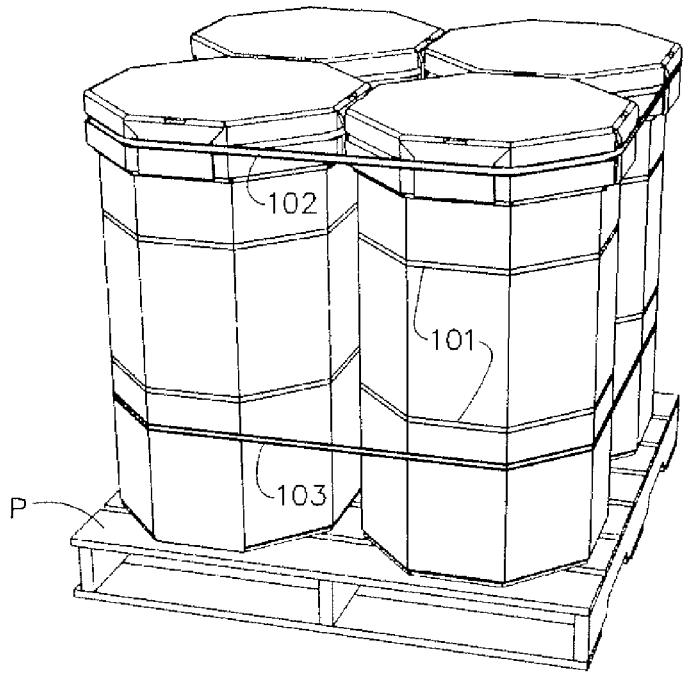
FIG. 26 shows several containers according to the invention with reinforcing bands applied to the sidewalls and with the containers strapped together and resting on a pallet.

Additional reinforcing straps 101 may be placed around the container at spaced locations along its height, as shown in FIG. 26. Plural containers may be placed on a pallet P and strapped together by bands 102 and 103, also as shown in FIG. 26.

Figure 27:
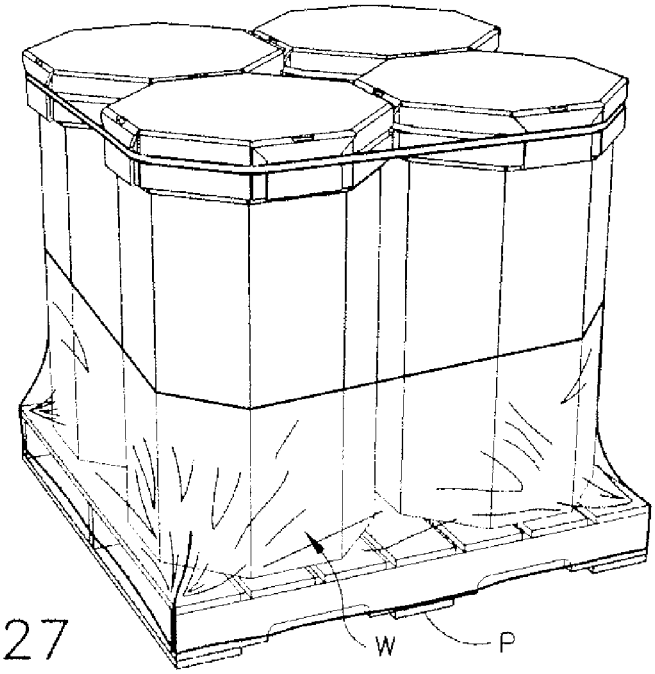
FIG. 27 depicts another way of securing several containers together and on a pallet, wherein stretch wrap is applied around the containers and a portion of the pallet.

In lieu of or in addition to the bands 102 and 103, stretch wrap or shrink wrap or the like W may be placed around a group of containers and a portion of the pallet P on which they are placed, as shown in FIGS. 25 and 27.

In FIG. 28 a pair of containers 10 is shown being lifted and carried by the tines of a forklift engaged beneath the rim 17 of the containers. The triple wall construction of the rim 17, its integral formation with the bin 11, its secure attachment to the bin sidewall, and the plurality of straight sections defined by it form a very strong and secure structure for lifting the container.

Figure 29:
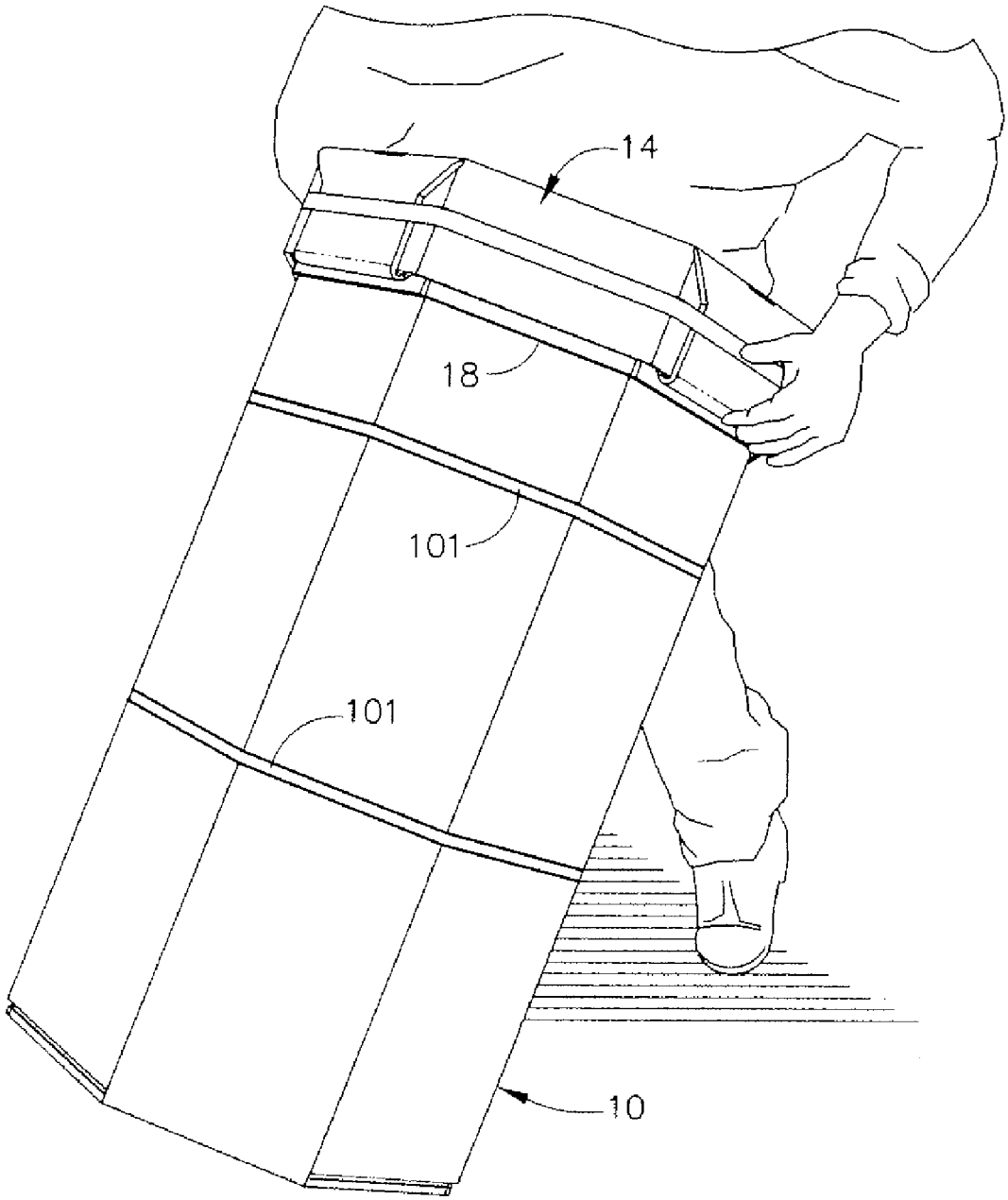
FIG. 29 depicts a container according to the invention having reinforcing bands applied to the lid and sidewall and being manually moved by rolling it on its bottom edge.

Further, as depicted in FIG. 29, the provision of a relatively wide rim at the top of the container and the construction of the container so that its sidewalls comprise a plurality of short straight sections provide good control of a container 10 being rolled on its bottom edge.

Figure 30:
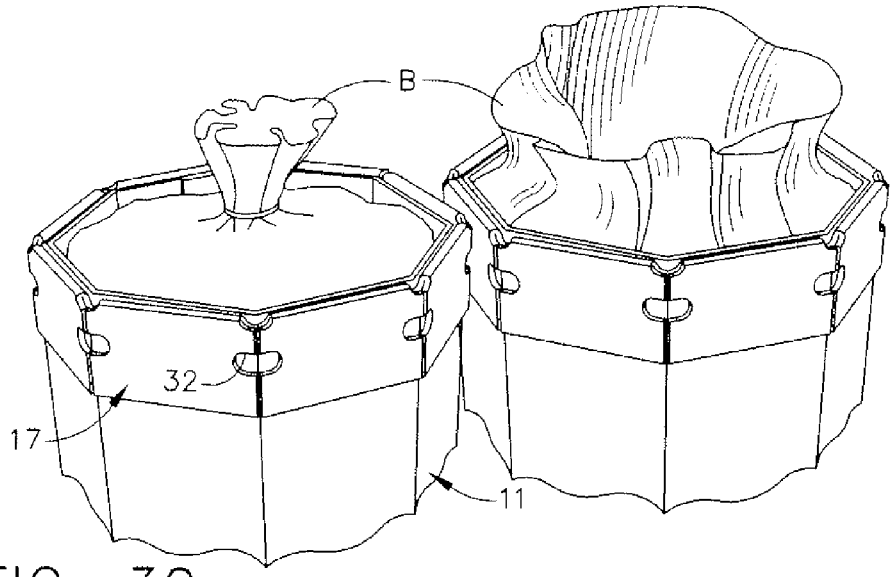
FIG. 30 shows an optional bag that may be placed in the container to hold liquids.

As shown in FIG. 30, a bag B may be placed in the bin, either in addition to the tray and liner inserts, or in lieu thereof, to provide a more secure leak-proof container, especially when liquids are being shipped and stored.

A blank B5 is shown in FIG. 31 for making an alternate embodiment of bin according to the invention. The blank B5 is substantially identical to the blank B1, except that the glue panel 15*i*' is much narrower than the glue flap in the previous embodiment, rim-forming flaps 17*a*'-17*h*' foldably joined to the top edge of the blank are separated from one another by slots 110 that extend a short distance 111 into the fold scores 25 between adjoining bin side panels 15*a*-15*h*, and the bottom flaps are arranged in a slightly different order. The extended areas 111 of the slots serve the same function as the cutouts 29 in the first embodiment, i.e. to relieve stress and prevent tearing of the material when the flaps are folded through 180°. Also, the outer corners of the flaps 17*a*'-17*h*' are cut away at 112 to form recessed areas on the bottom edge of the rim at the corners of the bin for locking the lid to the bin and/or receiving a tie strap. The lid locking structure and the strap receiving recesses thus are moved to the bottom edge of the rim 17' rather than being located between the top and bottom edges of the rim as in the first embodiment.

The use of the tray insert and liner is optional, but preferred. The drum of the invention is capable of shipping and storing liquid, semi-liquid, or dry products if the tray insert and liner are omitted, but their use is preferred. Use of straps or bands is also optional but preferred.

Figure 32:
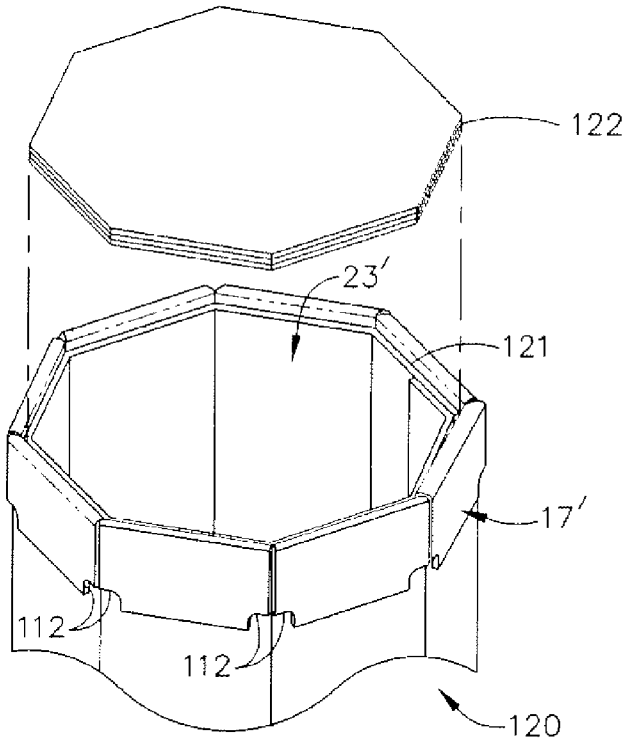
FIG. 32 is a fragmentary, exploded top perspective view of an alternate embodiment of bin according to the invention, wherein the liner insert terminates at its upper end short of the upper end of the bin and a shock absorbing pad is being inserted into the bin to rest against the upper end of the liner insert.
Figure 33:
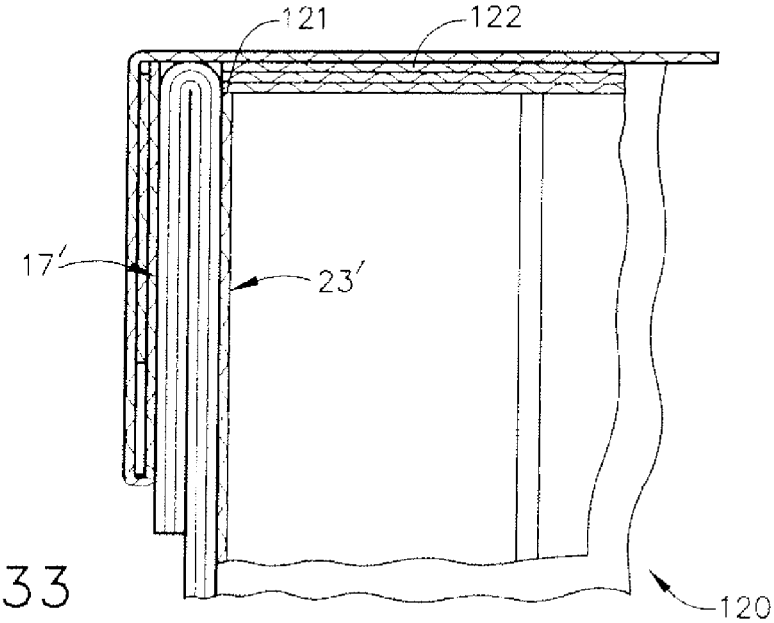
FIG. 33 is a fragmentary view in section of an upper portion of the container of FIG. 32, showing the pad resting on top of the liner.

A further embodiment is indicated generally at 120 in FIGS. 32 and 33, wherein the liner insert 23' is shortened so that its upper end 121 is spaced below the upper end of the bin sidewall, and a shock-absorbing and load-distributing pad 122 is placed on the upper end of the liner insert to rest between the liner and the lid (not shown). The pad reinforces the top of the container and helps to prevent displacement of the lid and leakage of product in the event the container is tipped over onto its side. In a preferred construction, the pad 122 is of triplewall construction. In all other respects the construction and function of this container is the same as that previously described.

The bin 11 preferably is triple wall CAA flute, and the tray insert, lid and liner preferably are single wall C flute. For increased strength, the direction of corrugations in the drum and liner can be extended at different angles. In a preferred embodiment, the flutes in the corrugated medium of the liner extend horizontally and the flutes of the corrugated medium in the bin extend vertically.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A bulk shipping and storage container, comprising:

a bin having a sidewall, a bottom wall and an open top, the sidewall comprising a plurality of interconnected sidewall panels extending at an angle with respect to one another;

a rim on an upper outer surface of the sidewall for engagement by the tines of a forklift to lift and carry the container, the rim comprising an outwardly and downwardly folded rim flap on an upper edge of each of the plurality of interconnected sidewall panel, the rim flaps being secured to an upper outer surface of each of the respective plurality of interconnected sidewall panel in contiguous parallel relationship thereto and each presenting a downwardly facing shoulder having a length substantially the same as the width of an associated sidewall panel and a thickness capable of securely supporting the container on the tines of a forklift;

recessed areas being formed in the rim at corners of the bin; and a lid closing the open top and wherein the lid has a depending peripheral skirt extending downwardly over the rim and bendable strips are formed in the skirt of the lid in positions to be in registry with the recessed areas in the rim when the lid is in place on the bin, the bendable strips and recessed areas forming a lid locking means when the strips are pushed inwardly into the recessed areas.

2. The container of claim 1, wherein:

the bin is octagonally shaped, with eight interconnected said sidewall panels and associated said rim flaps.

3. The container of claim 1, wherein:

the bin sidewall, the bottom wall and the rim flaps are made of triplewall corrugated fiberboard.

4. The container of claim 1, wherein:

a tray and a liner are disposed in the bin, the tray fitting closely with the bottom wall of the bin and the liner fitting closely at a bottom end thereof in the tray and extending at its other end to adjacent an upper end of the bin in closely fitting relationship against the sidewall of the bin.

5. A container as claimed in claim 1, wherein:

a reinforcing and retaining band is placed around the skirt of the lid, the band being received in depressions formed by pressing the bendable strips inwardly to lock the lid to the bin.

6. A bulk shipping and storage container, comprising:

a bin having a sidewall, an upper end, and a bottom wall, the sidewall comprising a plurality of interconnected sidewall panels extending at an angle with respect to one another;

an outwardly and downwardly folded rim flap is on an upper edge of each the sidewall panel;

recessed areas are formed in the rim at corners of the bin;

the bottom wall comprising a pair of generally hexagonally shaped major bottom flaps folded inwardly from respective first opposed sidewall panels, a pair of U-shaped rectangular minor bottom flaps folded inwardly from respective opposed second sidewall panels disposed orthogonally to the first sidewall panels, and intermediate triangularly shaped bottom flaps attached to side panels located between and extending angularly relative to the side panels carrying the hexagonally shaped major and U-shaped rectangular minor bottom flaps, one of the hexagonally shaped major bottom flaps and one of the U-shaped rectangular minor bottom flaps having an outwardly projecting tab on a free end edge thereof, and the other of the hexagonally shaped major and U-shaped rectangular minor bottom flaps having a complemental notch in a free end edge thereof, wherein the U-shaped rectangular minor bottom flaps are folded inwardly so that the tab on the end edge of the one minor flap extends into the notch in the free end edge of the other U-shaped rectangular minor bottom flap, the intermediate bottom flaps are folded inwardly to lie alongside and contiguous to the U-shaped rectangular minor bottom flaps, and the hexagonally shaped major bottom flaps are folded inwardly in overlapping relationship with the intermediate and U-shaped rectangular minor bottom flaps and adhesively secured thereto, the tab on the one major bottom flap being received in the notch in the other hexagonally shaped major bottom flap; and a lid being on the upper end of the bin, the lid having a depending peripheral skirt extending downwardly over the rim and bendable strips being formed in the skirt of the lid in registry with the recessed areas in the rim, the bendable strips and recessed areas forming a lid locking means when the strips are pushed inwardly into the recessed areas.

7. A container of claim 6, wherein:

the bin is octagonally shaped, with eight interconnected said sidewall panels.

8. A container of claim 6, wherein:

the rim flaps is secured to an upper outer surface of a respective associated said sidewall panel and together defining a rim extending around an upper outer surface of the bin, each of the rim flap presenting a downwardly facing shoulder having a length substantially the same as the width of an associated sidewall panel and a thickness capable of securely supporting the container on the tines of a forklift when the tines are engaged beneath rim flaps on opposite sides of said container.

9. A container of claim 6, wherein:

a tray and a liner are placed within the bin, the tray fitting closely in the bottom of the bin and the liner fitting closely at a bottom end thereof in the tray and extending at its other end to adjacent an upper end of the bin in closely fitting relationship against the sidewall of the bin.

10. A bulk shipping and storage container, comprising:

a bin having a sidewall, a closed bottom and an open upper end, the sidewall comprising a plurality of interconnected sidewall panels extending at an angle with respect to one another and defining a plurality of corners;

a rim extending around an upper outer surface of the bin, the rim comprising an outwardly and downwardly folded flap on an upper end of each of the sidewall panel;

recessed areas in the rim at each corner; and a lid closing the open upper end, the lid comprising a central panel having a marginal edge shaped complementally to the peripheral shape of the sidewall, and an annular skirt depending from the marginal edge and extending over at least a portion of the rim, the skirt having a plurality of corners corresponding to the corners of the bin sidewall, and a pair of slits extending across each corner of the skirt, defining a bendable strip at each corner that may be pushed into the recessed areas in the rim to lock the lid to the bin.

11. The container of claim 10, wherein:

the bin sidewall and the lid skirt are octagonal in shape, and the skirt comprises:

a first pair of opposed side flaps foldably joined to respective opposite edges of the central panel along first fold scores;

a second pair of opposed side flaps foldably joined to respective opposite edges of the central panel along second fold scores disposed orthogonally to the first fold scores, the flaps of the first and second pairs being identical to one another and each comprising a rectangular panel equal in width to an adjacent edge of the central panel, and an assembly flaps foldably joined to each of opposite ends of the rectangular panel along transverse fold scores;

a pair of spaced parallel cuts extending across each transverse fold score to define a bendable strip between the cuts;

a third pair of opposed side flaps foldably joined to respective opposite edges of the central panel along third fold scores extending angularly between first adjacent ends of the first and second fold scores;

a fourth pair of opposed side flaps foldably joined to respective opposite edges of the central panel along fourth fold scores extending angularly between second adjacent ends of the first and second fold scores, the flaps of the third and fourth pairs being identical to one another and each comprising a first irregularly shaped panel foldably joined to the central panel along a respective said third and fourth fold score, the first irregularly shaped panel having inset side edges, and a second irregularly shaped panel joined to the first irregularly shaped panel along a double fold score, the first irregularly shaped panel forming an outer side panel and the second irregularly shaped panel forming an inner side panel of the skirt, the assembly flaps on said first and second pairs of side flaps being captured between the inner and outer side panels; and a slot formed in the central panel adjacent the midpoint of each of the third and fourth fold scores, and a tab projecting from the center of an outer end edge of each of the second irregularly shaped panels, the tabs being received in the slots to hold the first, second, third and fourth pairs of opposed side flaps in erected configuration.

12. The container of claim 10, wherein:

the bin sidewall and the lid skirt are octagonal in shape, and the skirt comprises:

a first pair of opposed side flaps foldably joined to respective opposite edges of the center panel along first fold scores;

a second pair of opposed side flaps foldably joined to respective opposite edges of the central panel along second fold scores disposed orthogonally to the first fold scores, the flaps of the first and second pairs each having an assembly flap foldably joined to each of opposite ends thereof along transverse fold scores;

a pair of spaced parallel cuts extending across each transverse fold score to define a bendable strip between the cuts;

a third pair of opposed side flaps foldably joined to respective opposite edges of the center panel along third fold scores extending angularly between first adjacent ends of the first and second fold scores;

a fourth pair of opposed side flaps foldably joined to respective opposite edges of the central panel along fourth fold scores extending orthogonally to the third fold scores and angularly between second adjacent ends of the first and second fold scores, the flaps of the third and fourth pairs each comprising an inner panel and an outer panel, the assembly flaps on the first and second pairs of side flaps being captured between the inner and outer panels; and a slot formed in the central panel adjacent the midpoint of each of the third and fourth fold scores, and a tab projecting from the center of an outer end edge of each of the second irregularly shaped panels, the tabs being received in the slots to hold the first, second, third and fourth pairs of opposed side flaps in erected configuration.

13. A bulk shipping and storage container, comprising:

a bin having a sidewall, a closed bottom and an open top, the sidewall comprising a plurality of interconnected sidewall panels extending at an angle with respect to one another and defining corners of the bin;

a rim having an outwardly and downwardly folded rim flap on an upper edge of each said plurality of interconnected sidewall panel, the rim flaps define corners corresponding to the corners of the bin and a notch being formed in each corner of the rim;

a lid closing the open top, the lid has a depending peripheral skirt extending downwardly over the rim and having corners corresponding to the corners of the rim; and inwardly bendable strips in said skirt in registry with the notches in said rim so that the bendable strips can be pushed inwardly into the notches to lock the lid to the bin;

a shallow tray insert in the bottom of the bin, the tray having a bottom wall resting against the bottom of the bin and a sidewall resting against an inner surface of the bin sidewall;

an open-ended liner insert in the bin, the liner insert fitting closely at a bottom end thereof in the tray and extending upwardly in the bin in closely fitting relationship against the sidewall of the bin to an upper end spaced downwardly from the open top of the bin; and a shock-absorbing and force-distributing pad fitted in the bin between the lid and the upper end of the liner insert.

14. The container of claim 13, wherein:

the rim flaps being secured to an upper outer surface of a respective said sidewall panel in contiguous parallel relationship thereto and each presenting a downwardly facing shoulder having a length substantially the same as the width of an associated sidewall panel and a thickness capable of securely supporting the container on the tines of a forklift when the tines are engaged under the rim on opposite sides of the container.

15. A one-piece unitary blank of corrugated fiberboard for making a bulk container having a sidewall, an open top, and a closed bottom, comprising:

first, second, third, fourth, fifth, sixth, seventh and eighth sequentially arrayed, substantially identical, elongate, side-by-side rectangular sidewall-forming panels joined together along spaced parallel first fold scores, and a glue panel at one end of the blank;

a rim-forming flap foldably joined to one end of each of the sidewall-forming panels along a double fold score, and separated from one another by cuts, the rim-forming flaps forming a circumferential rim on an upper end of a container erected from the blank;

small stress relieving cutouts at the base of the cuts that separate the rim-forming flaps and between the double fold scores, extending slightly into the ends of the first fold scores;

second cutouts in the rim-forming flaps, extending across approximately the midpoint of the cuts, the second cutouts defining recessed notches extending across corners of a rim in a container erected from the blank;

a bottom-forming flap foldably joined to an end of each of the sidewall-forming panels opposite the end to which the rim-forming flaps are attached, the bottom-forming flaps comprising a generally hexagonally shaped major bottom flap on each of the fourth and eighth sidewall-forming panel, a triangularly shaped intermediate bottom flap on each of the first, third, fifth and seventh said sidewall-forming panel, and a U-shaped rectangular minor bottom flap on each of the second and sixth sidewall-forming panel, one of the hexagonally shaped major bottom flaps and one of the U-shaped rectangular minor bottom flaps having an outwardly projecting tab on an outer end edge thereof, and the other hexagonally shaped major bottom flap and U-shaped rectangular minor bottom flap having a complemental notch in an outer end edge thereof.

* * * * *